US007591602B2

(12) United States Patent
Fukumasu et al.

(10) Patent No.: US 7,591,602 B2
(45) Date of Patent: Sep. 22, 2009

(54) GAP DETECTOR, LIQUID EJECTING APPARATUS INCORPORATING THE SAME, AND GAP DETECTING METHOD EXECUTED IN THE APPARATUS

(75) Inventors: Keiichiro Fukumasu, Nagano-ken (JP); Kazuhiro Hashii, Nagano-ken (JP); Masafumi Furuyama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 430 days.

(21) Appl. No.: 11/349,944

(22) Filed: Feb. 9, 2006

(65) Prior Publication Data

US 2006/0193670 A1 Aug. 31, 2006

(30) Foreign Application Priority Data

Feb. 9, 2005 (JP) ..... 2005-032922
Jun. 22, 2005 (JP) ..... 2005-181796

(51) Int. Cl.
*B41J 11/20* (2006.01)
*B41J 25/308* (2006.01)

(52) U.S. Cl. ..... 400/59; 347/8

(58) Field of Classification Search ..... 400/55–56, 400/59; 347/8, 19, 101, 104
See application file for complete search history.

(56) References Cited

U.S. PATENT DOCUMENTS 5,245,359 A * 9/1993 Ito et al. ..... 346/139 R
2003/0122883 A1 7/2003 Park
2004/0258443 A1* 12/2004 Takeshita et al. ..... 400/58

FOREIGN PATENT DOCUMENTS

| | | | |
|---|---|---|---|
| EP | 1 464 510 | A2 | 10/2004 |
| JP | 6-8574 | A | 1/1994 |
| JP | 8-52922 | A | 2/1996 |
| JP | 9-109487 | A | 4/1997 |
| JP | 11-138942 | A | 5/1999 |
| JP | 2002-67428 | A | 3/2002 |
| JP | 2003-175654 | A | 6/2003 |
| JP | 2003-211778 | A | 7/2003 |
| JP | 2003-266846 | A | 9/2003 |
| JP | 2003-276273 | A | 9/2003 |
| JP | 2004-314591 | A | 11/2004 |

OTHER PUBLICATIONS

Extended European Search Report dated Jun. 23, 2009.

* cited by examiner

*Primary Examiner*—Marissa L Ferguson-Samreth
(74) *Attorney, Agent, or Firm*—Sughrue Mion, PLLC

(57) ABSTRACT

A gap detector is operable to detect a distance between a liquid ejecting head adapted to eject liquid toward a target medium and a platen adapted to support the target medium. A circular plate is adapted to be provided on a guide shaft which is rotated together with the rotary plate to selectively determine the distance as one of a plurality of distances. The circular plate has a plurality of flags formed on an outer periphery, each of which is associated with one of the distances. A sensor is disposed in the vicinity of the outer periphery of the circular plate and operable to output a signal indicative of a passage of each of the flags in accordance with the rotation of the circular plate. At least one of intervals between the flags in a circumferential direction of the circular plate is made different from the other.

10 Claims, 15 Drawing Sheets

GAP DETECTOR, LIQUID EJECTING APPARATUS INCORPORATING THE SAME, AND GAP DETECTING METHOD EXECUTED IN THE APPARATUS

BACKGROUND OF THE INVENTION

The present invention relates to a gap detector for detecting a gap between a liquid ejecting head and a target medium by detecting a rotating state of a carriage guide shaft.

The present invention also relates to a liquid ejecting apparatus incorporating such a gap detector and to a gap detecting method executed in such a liquid ejecting apparatus.

The liquid ejecting apparatus is not limited to a recording apparatus, such as a printer, a copier, or a facsimile, which employs an ink jet recording head and ejects ink from the recording head to a recording medium, to thus effect recording. The liquid ejecting apparatus is employed to encompasses an apparatus that ejects a liquid appropriate to an application, in place of ink from a liquid ejecting head corresponding to the ink jet recording head onto a target medium corresponding to a recording medium, thereby causing the liquid to adhere to the medium.

In addition to the recording head, the liquid ejecting head encompasses a coloring material ejecting head used for manufacturing a color filer such as a liquid-crystal display or the like; an electrode material (conductive paste) ejecting head used for forming electrodes, such as an organic EL display or a field emission display (FED) or the like; a bio-organic substance ejecting head used for manufacturing a bio-chip; a sample ejecting head serving as a precision pipette; and the like.

Some of the liquid ejecting apparatus are configured to be able to adjust a gap between a liquid ejecting head and a target medium or a platen for supporting the target medium (hereinafter abbreviated as "the platen gap"), as described in Japanese Patent Publication No. 2002-67428A, in order to appropriately perform recording (liquid ejection) on a variety of types of target media (recording media); more specifically, recording media of different thicknesses.

In the recording apparatus disclosed in the above publication, a carriage guide shaft is formed into an eccentric shaft structure, so that the carriage is vertically actuated in association with rotation of the carriage guide shaft, to thus control the platen gap. Further, the control of the platen gap is not manually performed but automatically controlled by rotating the carriage guide shaft with a driving force of a motor.

With this configuration, several positions for defining different platen gaps can be determined. For instance, there may be a case where four positions are set; namely, a position for recording information on plain paper, a position for recording information on a cardboard, a position for recording data on an optical disk, and a position where a tray having an optical disk set thereon is inserted. In order to achieve a superior recording result, appropriate print control must be performed for each position.

Accordingly, when recording is carried out, a control section of a printer must recognize the current platen gap. To this end, a detector for detecting the current platen gap is required. Japanese Patent Publication Nos. 2003-211778A and 2004-314591A disclose a technique for detecting the current platen gap. For instance, Japanese Patent Publication No. 2003-211778A discloses a device capable of identifying four positions by a combination of activation/deactivation of two sensors. Japanese Patent Publication No. 2004-314591A discloses a stable area sensor. In this sensor, a disc, which has four light-shielding plates provided around an outer periphery thereof, is attached to a carrier guide shaft, to thus detect a light-shielding plate that is now blocking the optical sensor. Since each of the light-shielding plates corresponds to one of the platen gaps, the current platen gap can be determined based on the detection result.

However, the above technique requires a plurality of exclusive sensors for detecting a plurality of platen gaps, which has become a factor for incurring a cost hike.

This technique also raises the following problem. Provision of an exclusive motor for switching the platen gap entails a cost hike. Accordingly, the recording apparatus is desirably constructed to cause the motor that drives a roller for transporting a recording medium to double as a motor for switching the platen gap; and to transmit or cut off power from the motor to the carriage guide shaft, as required. Here, operation for switching transmission and cut-off of power from the motor to the carriage guide shaft can also be performed by a carriage. Specifically, the recording apparatus is provided with an actuated member and the actuated member is pressed by the carriage, to thus switch transmission of power from the motor to the carriage guide shaft.

With this configuration, the number of components can be curtailed, which is preferable in terms of cost. However, the construction raises the following problem. Specifically, when a recording sheet is present in a position where a carriage opposes a recording head during the course of the carriage proceeding to press the actuated member, the recording head may rub against the recording sheet when switching to the platen gap appropriate to the recording sheet has not yet been performed, or the recording head may collide with a side edge of the recording sheet, to thus cause paper jamming. When a tray having a plate-shaped member, such as an optical disk, set therein is inserted into a transporting path while sufficiently-large the platen gap is not ensured, the tray collides with a recording head in the same manner, which in turn may induce a failure. If a distance, over which the carriage travels, is long when the carriage proceeds to press the actuated member, operation for switching the platen gap requires consumption of much time.

SUMMARY OF THE INVENTION

It is therefore an object of the invention to provide a gap sensor capable of accurately detecting a plurality of platen gaps with a low-cost configuration.

It is also an object of the invention to provide a liquid ejecting apparatus capable of preventing occurrence of interference between a liquid ejecting head and a target medium.

It is also an object of the invention to provide a liquid ejecting apparatus capable of adjusting the platen gap quickly.

In order to achieve at least one of the above objects, according to the invention, there is provided a gap detector, operable to detect a distance between a liquid ejecting head adapted to eject liquid toward a target medium and a platen adapted to support the target medium, comprising:

a circular plate, adapted to be provided on a guide shaft which is rotated together with the rotary plate to selectively determine the distance as one of a plurality of distances, the circular plate comprising a plurality of flags formed on an outer periphery, each of which is associated with one of the distances; and a sensor, disposed in the vicinity of the outer periphery of the circular plate and operable to output a signal indicative of a passage of each of the flags in accordance with the rotation of the circular plate, wherein at least one of intervals between the flags in a circumferential direction of the circular plate is made different from the other.

One of the flags forming the at least one of the intervals may be associated with a minimum one of the distances.

In order to achieve at least one of the above objects, according to the invention, there is also provided a liquid ejecting apparatus, comprising:

a liquid ejecting head, adapted to eject liquid toward a target medium;

a platen, adapted to support the target medium;

a rotatable guide shaft, extending in a first direction;

a carriage, mounting the liquid ejecting head and being supported by the guide shaft so as to reciprocately movable thereon;

a gap adjuster, operable to rotate the guide shaft, thereby moving an axis of the guide shaft in a second direction orthogonal to the first direction to selectively determine a distance between the liquid ejecting head and the platen as one of a plurality of distances;

a circular plate, provided on the guide shaft and rotatable together with the guide shaft, the circular plate comprising a plurality of flags formed on an outer periphery thereof, each of which is associated with one of the distances; and a sensor, disposed in the vicinity of the outer periphery of the circular plate and operable to output a signal indicative of a passage of each of the flags in accordance with the rotation of the circular plate, wherein at least one of intervals between the flags in a circumferential direction of the circular plate is made different from the other.

With this configuration, the rotation amount of the rotary plate (i.e., the first motor), which is required after a certain flag has passed by the sensor before the next flag is detected, corresponds to the unique interval, whereby the flag detected at that time can be determined to be at least one of the two flags whose interval is unique. On the basis of the rotational direction of the rotary plate (i.e., the first motor) obtained at that time, the detected flag can be identified as one of the two flags; namely, one of the plurality of flags.

So long as the thus-detected flag can be identified as any one of a plurality of the flags (as corresponding to any one of the distances), a positional relationship between the identified flag and another flag is determined in advance. Accordingly, the position of the other flag; i.e., the rotation amount of the first motor required to change the distance between the liquid ejecting head and the platen (platen gap) can be determined.

Thus, an exclusive sensor to detect the platen gap can be embodied by one sensor. For this reason, cost can be curtailed. Detection of the unique interval requires a sensor that detects the rotation amount of the first motor used for rotating the guide shaft; namely, the rotation amount of the rotary plate.

Moreover, since the flags are provided such that each of those is associated with one of the selectable distances, the respective distances can be detected without fail. Namely, selection of the platen gap can be elected without fail.

One of the flags forming the at least one of the intervals may be associated with a minimum one of the distances.

By taking this flag as a reference flag, the guide shaft is rotated, to thus sequentially increase the platen gap, and hence control is facilitated.

The liquid ejecting apparatus may further comprise: a first motor, operable to rotate the guide shaft; a detector, operable to detect a rotation amount of the first motor; and a controller, operable to identify one of the flags forming the at least one of the intervals with reference to the signal and the rotation amount.

Here, the liquid ejecting apparatus may further comprise: a second motor, operable to move the carriage along the guide shaft; and a transmitter; configured to be actuated by the carriage so as to be either a first state for transmitting a driving force from the first motor to the guide shaft, or a second state for not transmitting the driving force from the first motor to the guide shaft. In this case, the controller is configured to drive the second motor to move the carriage so as to place the transmitter in the first state before the identification of the one of the flags.

Here, the transmitter may comprise: a gear train, coupling the first motor and the guide shaft, the gear train including a spur gear having a rotary shaft extending parallel to the first direction; and an urging member, urging the spur gear toward the carriage. In this case, the spur gear is slidable in the first direction between a first position meshing with an adjacent gear in the gear train to place the transmitter in the first state and a second position separating from the adjacent gear to place the transmitter in the second state. The spur gear is placed in the first position when the carriage presses the rotary shaft against an urging force of the urging member. The spur gear is placed in the second position in accordance with the urging force when the carriage is separated from the rotary shaft. The controller is configured to drive the second motor to move the carriage so as to separate from the rotary shaft, after the identification of the one of the flags. The controller is configured to drive the first motor so as to reverse a rotating direction thereof, after the separation of the carriage from the rotary shaft Teeth of the gears may remain in press contact with each other even if the carriage has separated from the spur gear, thereby failing to move the spur gear to the second position. Accordingly, there may arise a case where the transmitter is not placed in the second state. However, with the above configuration, the press contact between the teeth of the gears is lessened or cancelled, whereby the engagement section can be displaced smoothly from the first position to the second position. Specifically, the transmitter can be brought into the second state without fail.

The liquid ejecting apparatus may further comprise a transmitter, configured to be actuated by the carriage so as to be either a first state for transmitting a driving force from the first motor to the guide shaft, or a second state for not transmitting the driving force from the first motor to the guide shaft, the transmitter disposed in an opposite side to a transporting path of the target medium relative to a home position of the carriage.

With this configuration, the carriage does not need to straddle the transporting path of the target medium during the course of the carriage proceeding from the home position to actuate the transmitter; namely, the carriage does not interfere with the target medium. Consequently, even when the platen gap is set in an inappropriate state, occurrence of interference occurs between the liquid ejecting head and the target medium. Moreover, the travel distance of the carriage required to proceed to actuate the transmitter can be shortened, and operation for changing the platen gap can be performed within a short period of time.

Here, the transporting path may be adapted to transport a tray member mounting the target medium.

With this configuration, during the course of proceeding from the home position to actuate the transmitter, the carriage does not interfere with the tray. Occurrence of interference between the liquid ejecting head and the tray can be prevented, and there is no potential risk of inducing a failure or the like.

Moreover, the liquid ejecting apparatus may further comprise a first roller, adapted to transport the target medium in a third direction orthogonal to the first direction a the second direction, the roller arranged in an upstream side of the liquid ejecting head relative to the third direction. In this case, the transmitter is configured to transmit the driving force by way of the roller.

With this configuration, when compared with a configuration which employs an exclusive motor for rotating the guide shaft, an attempt to achieve cost-saving can be enabled.

Here, the liquid ejecting apparatus may further comprise a second roller, adapted to transport the target medium toward the first roller. In this case, the transmitter is configured to rotate the second roller in cooperation with the first roller.

With this configuration, the first roller, the second roller, and the guide shaft are driven by a single motor. Therefore, further cost-saving can be attained.

The transmitter may comprise a gear train, coupling the first motor and the guide shaft, the gear train including a spur gear having a rotary shaft extending parallel to the first direction. In this case, the spur gear is slidable in the first direction between a first position meshing with an adjacent gear in the gear train to place the transmitter in the first state and a second position separating from the adjacent gear to place the transmitter in the second state.

With this configuration, the switching between the first state and the second state of the transmitter can be attained with a simple and inexpensive configuration.

In order to achieve at least one of the above objects, according to the invention, there is also provided a gap detecting method executed in the above liquid ejecting apparatus, comprising:

rotating the guide shaft with a first motor;

detecting a rotation amount of the first motor; and identifying one of the flags forming the at least one of the intervals with reference to the signal and the rotation amount.

Here, the detecting method may further comprise:

providing a transmitter, configured to be actuated by the carriage so as to be either a first state for transmitting a driving force from the first motor to the guide shaft, or a second state for not transmitting the driving force from the first motor to the guide shaft; and moving the carriage along the guide shaft with a second motor so as to place the transmitter in the first state before the identification of the one of the flags.

Here, the detecting method may further comprise:

configuring the transmitter so as to comprise:

a gear train, coupling the first motor and the guide shaft, the gear train including a spur gear having a rotary shaft extending parallel to the first direction; and an urging member, urging the spur gear toward the carriage;

configuring the spur gear so as to be slidable in the first direction between a first position meshing with an adjacent gear in the gear train to place the transmitter in the first state and a second position separating from the adjacent gear to place the transmitter in the second state;

driving the second motor to move the carriage so as to press the rotary shaft against an urging force of the urging member, thereby placing the spur gear in the first position;

driving the second motor to move the carriage so as to separate from the rotary shaft, after the identification of the one of the flags, thereby placing the spur gear in the second position in accordance with the urging force when the carriage is separated from the rotary shaft; and driving the first motor so as to reverse a rotating direction thereof, after the separation of the carriage from the rotary shaft.

In order to achieve at least one of the above objects, according to the invention, there is also provided a program product comprising a program causing a computer to execute the above detecting method.

BRIEF DESCRIPTION OF THE DRAWINGS

The above objects and advantages of the present invention will become more apparent by describing in detail preferred exemplary embodiments thereof with reference to the accompanying drawings, wherein:

FIGS. 8A through 9A are side views showing how to operate the platen gap adjuster;

DETAILED DESCRIPTION OF THE EMBODIMENTS

Figure 1:
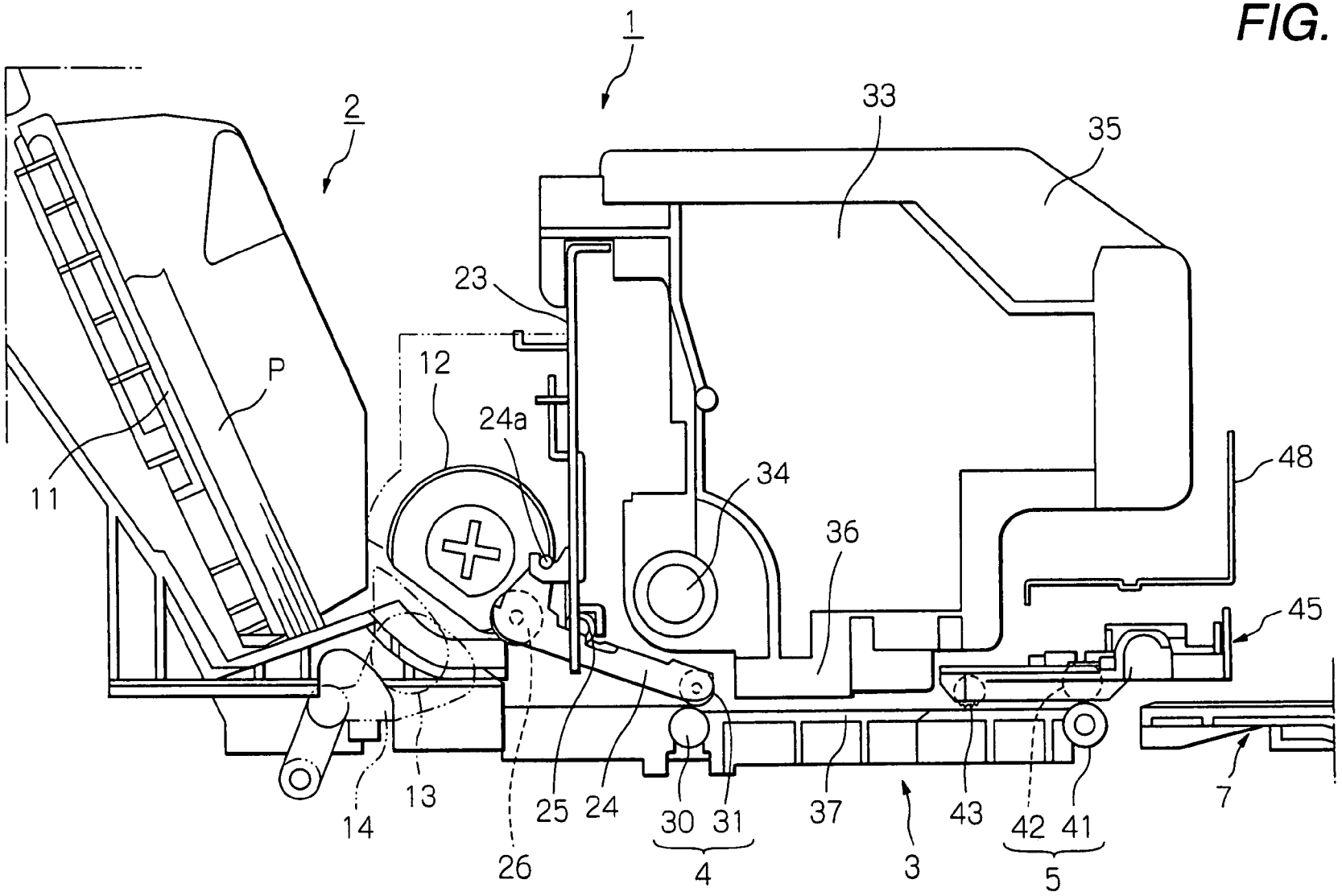
FIG. 1 is a schematic section view of a printer according to one embodiment of the invention.

Embodiments of the invention will be described below in detail with reference to the accompanying drawings.

An ink jet printer (hereinafter simply called a "printer") 1, which is employed as an example of a recording apparatus or a liquid ejecting apparatus, will be described as one embodiment. In the following description, the right direction (the front side of the printer) in FIG. 1 will be referred to as "downstream" relative to a transporting direction of a recording medium (target medium). The left direction (the rear side of the printer) will be referred to as "upstream" relative to the transporting direction.

A feeder 2, into which recording media (target media) P in a cut-sheet form (hereinbelow referred to as "sheet P") can be set in an inclined posture, is provided in a rear section of the printer 1. A sheet P is fed from the feeder 2 to a transporter 4 located downstream. The thus-fed sheet P is transported downstream to a recording section 3 by the transporter 4, whereby recording is effected. The sheet P recorded by the recording section 3 is ejected forward of the recording apparatus by an ejector 5 located downstream.

Figure 15:
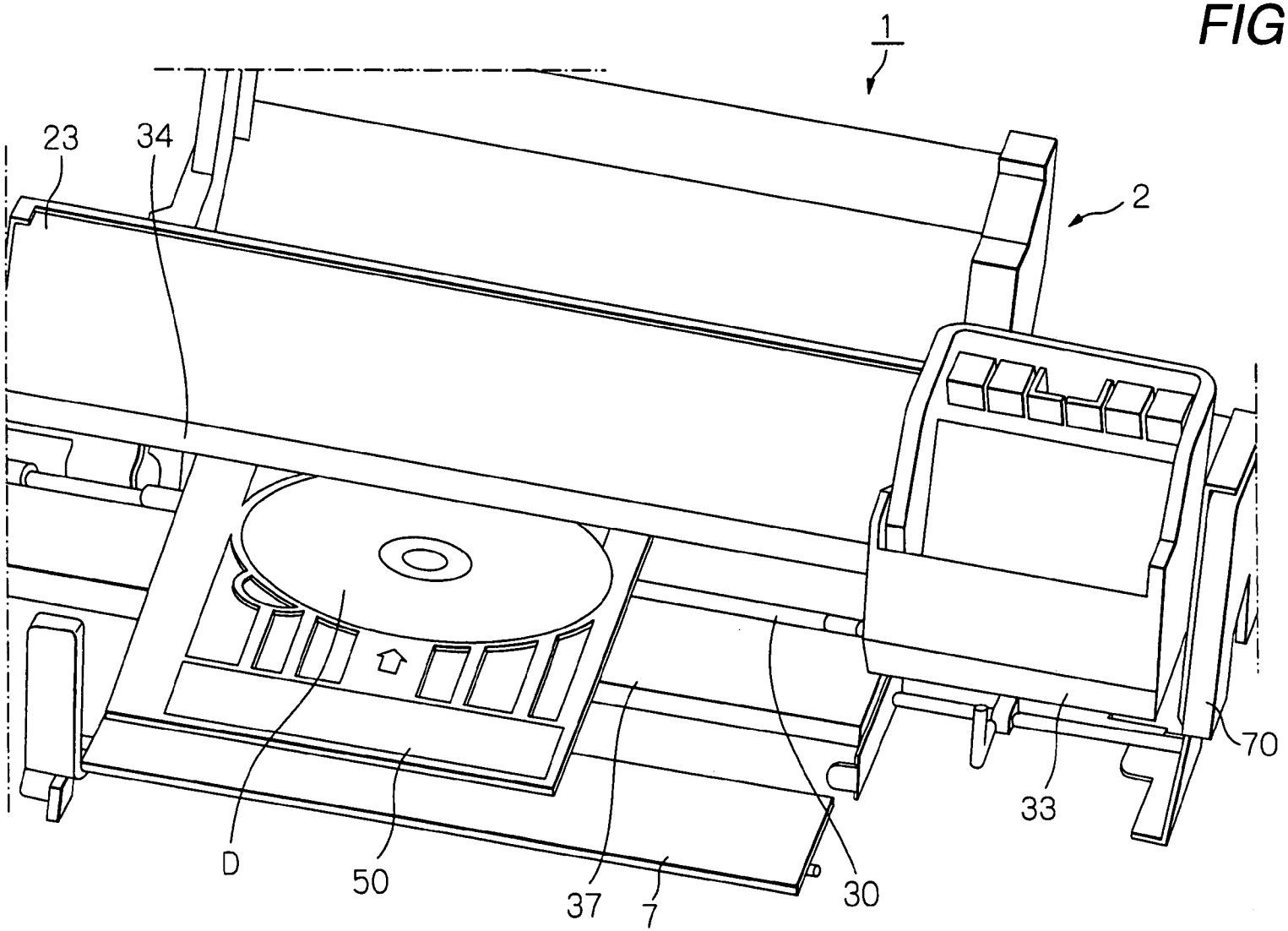
FIG. 15 is an enlarged perspective view of a front section of the printer.

As shown in FIG. 15, the printer 1 is constructed to be able to transport a tray 50 adapted to carry an optical disk D, by the transporter 4, and to be able to perform recording of information on a label surface of the optical disk D set in the tray 50 by the recording section 3. Reference numeral 7 denotes a tray guide for supporting the tray 50, and the tray 50 is inserted into the printer 1 from the front to the rear by way of the tray guide 7 and is transported to the recording section 3 by the transporter 4.

Constituent elements disposed in the medium transporting path of the printer 1 will be described in more detail. The feeder 2 is constructed of a hopper 11, a feeding roller 12, a retard roller 13, and a returning lever 14.

The hopper 11 is formed from a plate-shaped element and constructed to be able to-pivot about a pivot center (not shown) provided in an upper part of the hopper 11. As a result of the hopper 11 pivoting, the inclined sheet P supported on the hopper 11 is brought into press contact with the feeding roller 12 or caused to retract from the feeding roller 12. The feeding roller 12 essentially assumes the shape of the letter D when viewed from the side. The feeding roller 12 feeds downstream the top sheet P, which remains in press contact with an arcuate portion of the D-shaped cross section of the feeding roller 12. During the course of the sheet P being transported by the transporter 4 after feeding of the sheet P, the transporter 4 is controlled such that a flat portion of the D-shaped cross section of the feeding roller 12 opposes the sheet P as illustrated, so as to prevent occurrence of transport load.

The retard roller 13 is provided so as to be able to come into press contact with the arcuate portion of the feeding roller 12. When overlapping transfer of the sheets P does not arise and only one sheet P is being fed, the retard roller 13 comes into contact with the sheet P to be thus rotated (clockwise in FIG. 1). When a plurality of the sheets P are present between the feeding roller 12 and the retard roller 13, the retard roller 13 does not rotate and remains stationary, because the frictional coefficient between the sheets P is lower than the frictional coefficient between the sheet P and the retard roller 13. Consequently, sheets P, which are subsequent to the top sheet P and are about to be delivered in an overlapping manner along with the top sheet P to be fed, do not proceed downstream from the retard roller 13, thereby preventing overlapped delivery of the sheets P. The returning lever 14 is pivotably provided and performs operation for returning to the hopper 11 sheets P, which are subsequent to the top sheet and have been prevented from being delivered in an overlapping manner.

A sensor (not shown in FIG. 1) for detecting passage of the sheet P and a guide roller 26, which sets an attitude for feeding the sheet P and prevents the sheet P from contacting the feeding roller 12 to thus lessen transport load, are interposed between the feeding device 2 and the transporter 4. In the present embodiment, the guide roller 26 is rotatably supported by an upstream end of an upper guide 24.

The transporter 4 provided downstream of the feeder 2 comprises a transporting roller 30 rotationally driven by a power feeding motor 52 (see FIG. 2) and a transporting follower-roller 31 which comes into press contact with the transporting roller 30 and rotates in a following manner. The transporting roller 30 is formed from an adhesion layer which is formed by dispersing, in an essentially uniform manner, wear-and-brasion resistant particles over an outer peripheral surface of a metal shaft extending in the widthwise direction of the sheet. An outer peripheral surface of the transporting follower roller 31 is formed from low frictional material, such as an elastomer or the like. A plurality of the transporting follower rollers 31 are provided around the transporting roller 30 in the axial direction thereof.

In the present embodiment, two transporting follower rollers 31 are axially supported by a downstream end portion of one upper paper guide 24 so as to be able to freely rotate. As shown in FIG. 1, three transporting follower rollers 31 are arranged side by side on the paper guide 24 in the widthwise direction of the sheet. A shaft 24*a* is axially supported by a main frame 23, and hence the sheet guide 24 is pivotable about the shaft 24*a* when the medium transporting path is viewed from the side. The transporting follower rollers 31 are urged by a coil spring 25 in a direction to come into press contact with the transporting roller 30.

The sheet P having reached the transporter 4 is transported to the recording section 3 located downstream, by rotation of the transporting roller 30, while being nipped between the transporting roller 30 and the transporting follower rollers 31.

The recording section 3 comprises an ink jet recording head (hereinafter referred to as a "recording head") 36 and a lower guide (platen) 37 provided so as to oppose the recording head 36. The recording head 36 is provided at the bottom of a carriage 33, and the carriage 33 is driven so as to move back and forth in the primary scanning direction by a carriage driving motor 113 (see FIG. 2) while being guided by a carriage guide shaft 34 extending in the primary scanning direction. The carriage 33 carries ink cartridges 35 of a plurality of colors which are independent of each other, and supplies ink to the recording head 36.

Ribs (not shown) and a recess (not shown), where ink is discarded, are formed on a surface of the lower guide 37 opposing the recording head 36, which defines a distance between the sheet P and the recording head 36. Ink ejected to an area outside the edges of the sheet P is discarded to the recess, thereby effecting so-called marginless printing where printing is carried out so as not to leave margins on the sheet P.

The position of the axial core of the carriage guide shaft 34 can be displaced by a platen gap adjuster 51 (described later in detail). Thereby, a gap between the sheet P (or the platen 37) and the recording head 36 (platen gap) can be adjusted. This adjustment will be described in detail later.

Subsequently, a guide roller 43 and the ejector 5 are provided downstream of the recording head 36. The guide roller 43 exhibits the function of preventing lift of the sheet P from the lower guide 37, to thus maintain the distance between the sheet P and the recording head 36 constant. The ejector 5 comprises an ejecting roller 41 to be rotationally driven by the power feeding motor 52; and an ejecting follower roller 42 which comes into contact with the ejecting roller 41 and is rotated in a driven manner.

In the present embodiment, the ejecting roller 41 is formed from a rubber roller, and a plurality of the ejecting rollers 41 are provided around a shaft element, which is rotationally driven, in an axial direction thereof. The ejecting follower roller 42 is formed from a toothed roller having a plurality of teeth provided along an outer periphery thereof. A plurality of the ejecting follower rollers 42 are provided in a frame assembly 45, which is elongated in the primary scanning direction, so as to correspond to the plurality of ejecting rollers 41. The sheet P, on which information is recorded by the recording section 3, is rotationally driven by the ejecting rollers 41 while being nipped between the ejecting rollers 41 and the ejecting follower rollers 42, and is ejected forward of the recording apparatus to an ejected sheet stacker (not shown).

The frame assembly 45 is provided in such a way that the assembly can be displaced by a releaser 6 (described later) so as to be able to assume a contact position where the ejecting follower rollers 42 come into contact with the ejecting rollers 41, and a retracted position where the ejecting follower rollers 42 are retracted from the ejecting rollers 41.

Figure 2:
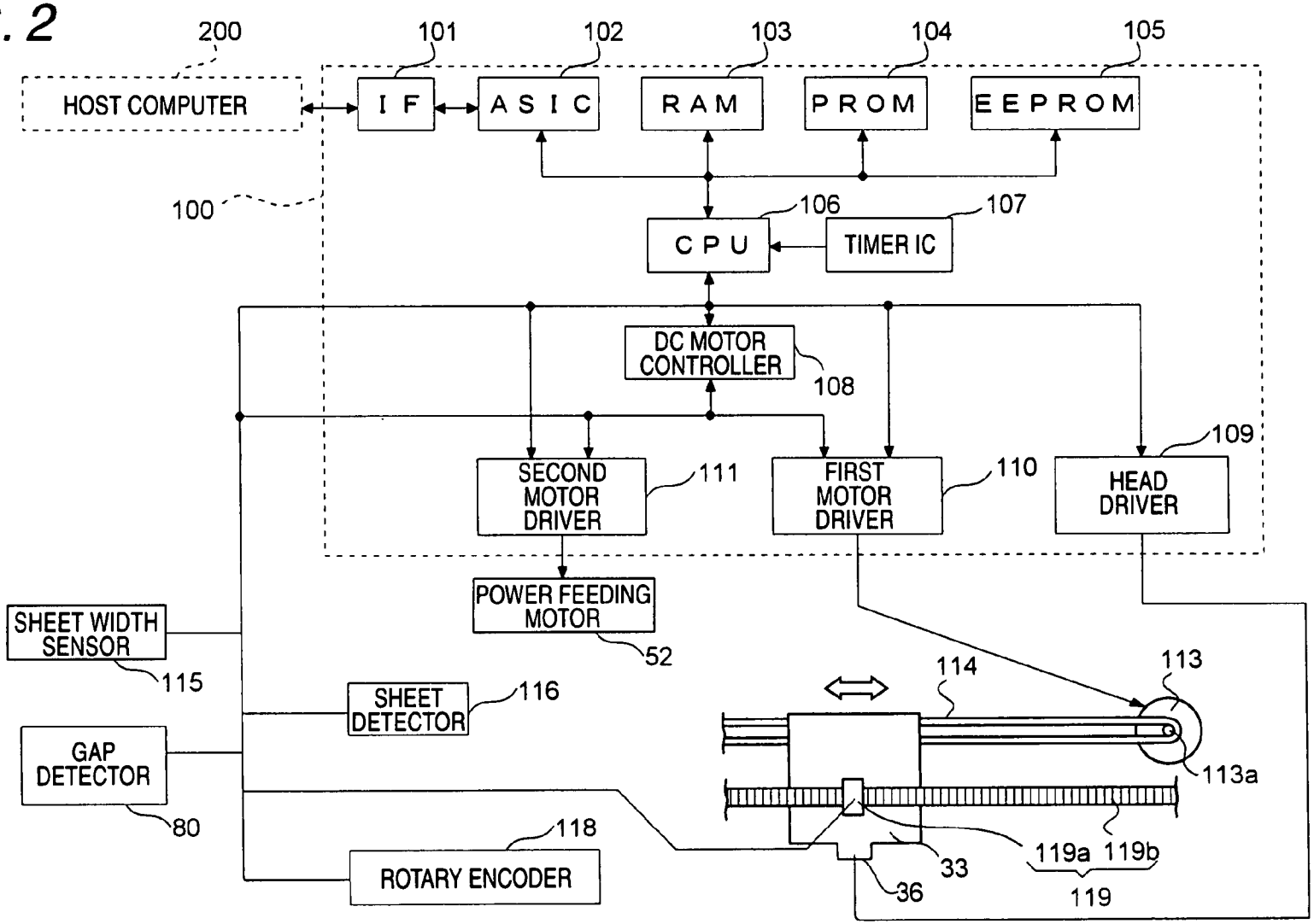
FIG. 2 is a block diagram showing a control section of the printer.

Next, the control section 100 that executes various control operations of the printer 1 and the peripheral configuration of the control section 100 will now be described by reference to FIG. 2. The control section 100 is constructed so as to be able to exchange data with a host computer 200 which transmits print information (print data) to the printer 1. The control section comprises an IF 101 which is an interface with the host computer 200; an ASIC 102; a RAM 103; a PROM 104; an EEPROM 105; a CPU 106; a timer IC 107; a DC motor controller 108; a first motor driver 110; a second motor driver 111; and a head driver 109.

The CPU 106 performs arithmetic operation for executing the control program of the printer 1 and other required arithmetic operations, and the timer IC 107 causes the CPU 106 to generate periodic interrupt signals required for various types of processing operations. The ASIC 102 controls print resolution or a drive waveform of the recording head 36 in accordance with print data transmitted from the host computer 200 by way of the IF 101. The RAM 103 is used as a work area for the ASIC 102 and the CPU 106 or a primary storage area for other data. Various control programs (firmware) required to control the printer 1, data required for processing, and the like, are stored in the PROM 104 and the EEPROM 105.

The DC motor controller 108 is a circuit for controlling the speed of DC motors (the carriage driving motor 113 and the power feeding motor 52), and has a PID control circuit, an acceleration control section, and a PWM control circuit, all of which are omitted from the drawings. The DC motor controller 108 executes various operations for controlling the speed of the DC motor in accordance with a control command output from the CPU 106 and signals output from sensors such as a rotary encoder 118, a linear encoder 119, a sheet detector 116 for detecting passage of the sheet P, a sheet width sensor 115, a platen gap detector 80, and the like. The DC motor controller 108 sends a signal to the first motor driver 110 and the second motor driver 111.

Under control of the DC motor controller 108, the second motor driver 111 controls driving of the power feeding motor 52. The power feeding motor 52 serves as a common power source for a plurality of objects of driving in the present embodiment; namely, the feeding roller 12, the transporting roller 30, the ejecting roller 41, the carriage guide shaft 34, and the like.

The first motor driver 110 controls driving of the carriage driving motor 113 under control of the DC motor controller 108, thereby moving the carriage 33 back and forth in the primary scanning direction or halting and holding the carriage 33. The head driver 109 controls driving of the recording head 36 under control of the CPU 106 in accordance with the print data transmitted from the host computer 200.

The CPU 106 and the DC motor controller 108 are provided with a detection signal output from the sheet detector 116 that detects the leading end and trailing end of the transported sheet P; a signal output from the rotary encoder 118 for detecting the number of rotation steps, rotating direction, and rotational speed of the power feeding motor 52; and a signal output from the linear encoder 119 that detects the absolute position of the carriage 33 in the primary scanning direction. The CPU 106 and the DC motor controller 108 are provided with a signal output from the sheet width sensor 115, as well.

This sheet width sensor 115 is an optical sensor provided on the bottom of the carriage 33; and has a light-emitting section (not shown) for emitting light toward the sheet P and a light-receiving section (not shown) for receiving the light reflected from the sheet P. The sheet width sensor 115 detects a difference in reflectivity on the sheets P. By the thus-detected difference in reflectivity, the control section 100 detects presence/absence of the sheet P and the width of the sheet P in association with sensing activity of the sheet width sensor 115.

The rotary encoder 118 has a disc-shaped scale (not shown) having in an outer peripheral section thereof a plurality of light transmission sections and a sensing section (not shown) which has a light-emitting section for emitting light to the light transmission sections and a light-receiving section for receiving the light having passed through the light transmission sections. In accordance with rotation of the disc-shaped scale, the sensing section outputs a rise signal and a fall signal, which are formed as a result of light having passed through the light transmission sections. Upon receipt of the signal output from such a rotary encoder 118, the control section 100 detects the number of rotation steps, rotational speed, and rotating direction of an object to be driven by the power feeding motor 52 (the transporting roller 30, the ejecting roller 41, the carriage guide shaft 34, and the like). Thereby, intended various control operations can be executed.

The linear encoder 119 has a sign board **119*b* elongated in the primary scanning direction and a sensing section 119*a* that has a light-emitting section for emitting light toward a plurality of light transmission sections formed in the sign board 119*b* in the primary scanning direction and a light-receiving section for receiving the light having passed through the light transmission sections. The sensing section 119*a* outputs a rise signal and a fall signal, which are formed as a result of light having passed through the light transmission sections, and the control section 100 detects the position of the carriage 33 in the primary scanning direction by receiving the signal output from such a sensing section 119*a***.

Next, the platen gap adjuster will be described in detail with reference to FIGS. 3 through 11.

Figure 4:
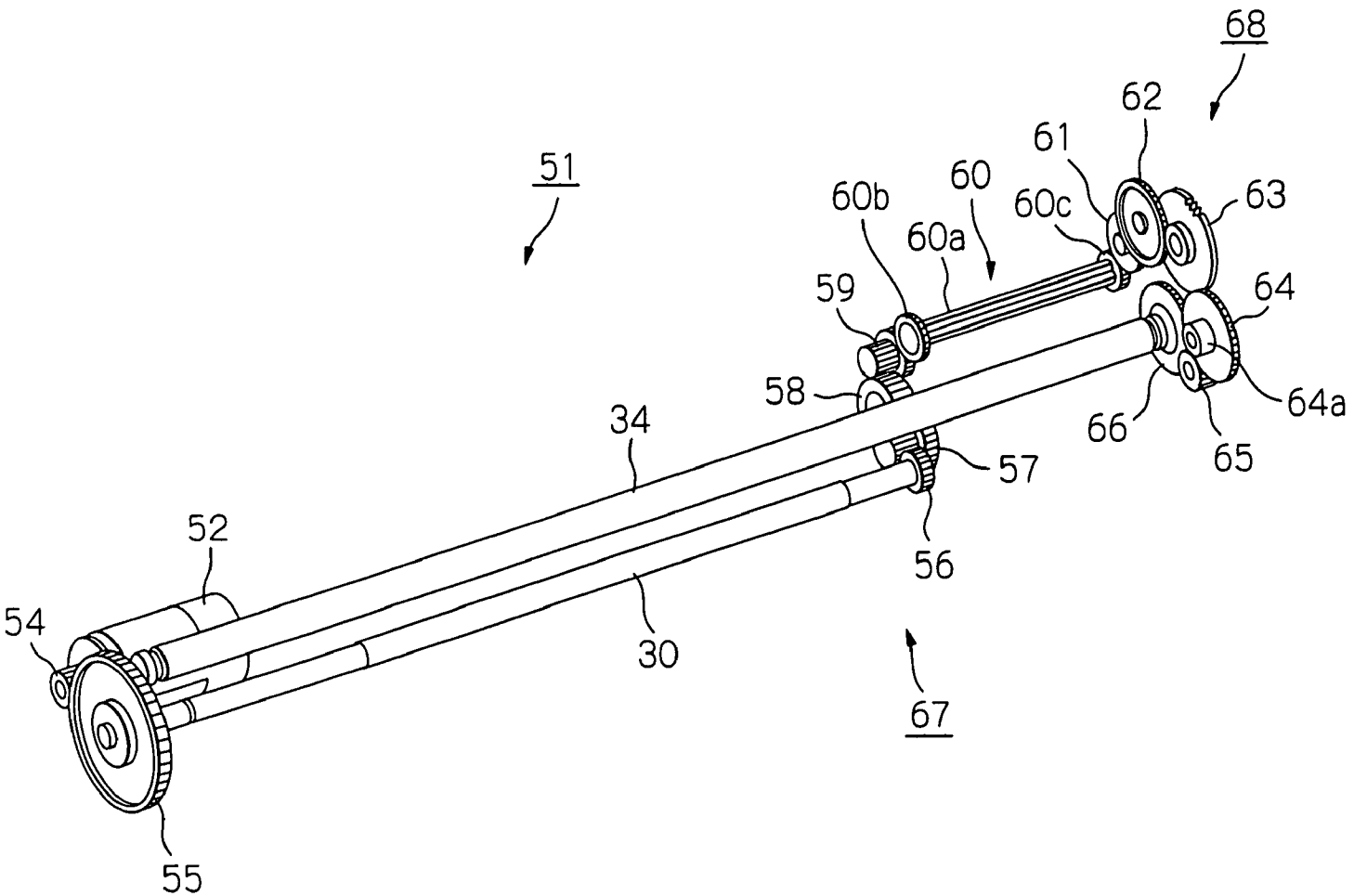
FIG. 4 is a perspective view of a part of a platen gap adjuster in the printer.

As shown in FIG. 4, the platen gap adjuster 51 comprises the power feeding motor 52 and a power transmitter 67 for transmitting power from the power feeding motor 52 to the carriage guide shaft 34.

Figure 3:
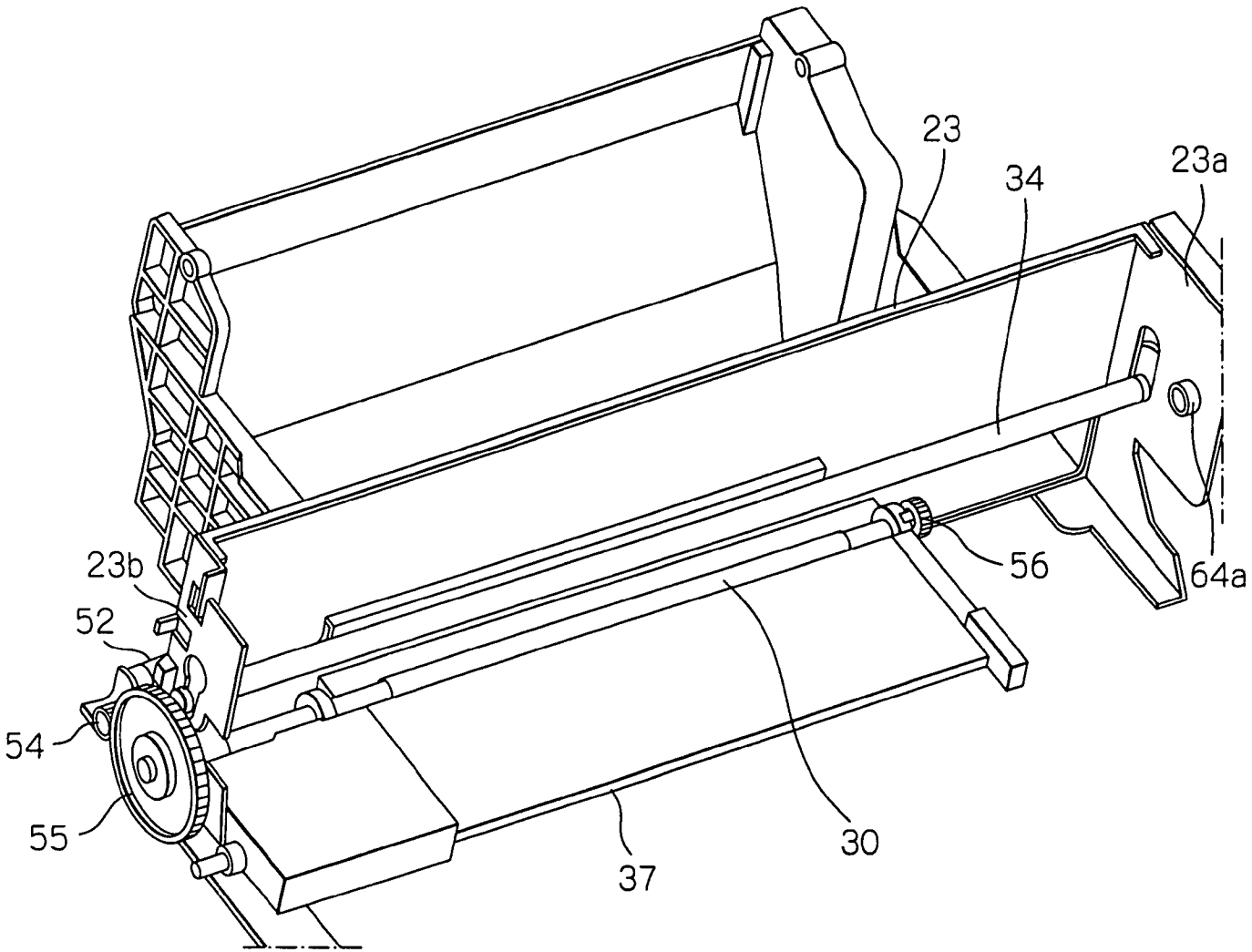
FIG. 3 is a perspective view of an internal structure of the printer.
Figure 7A:
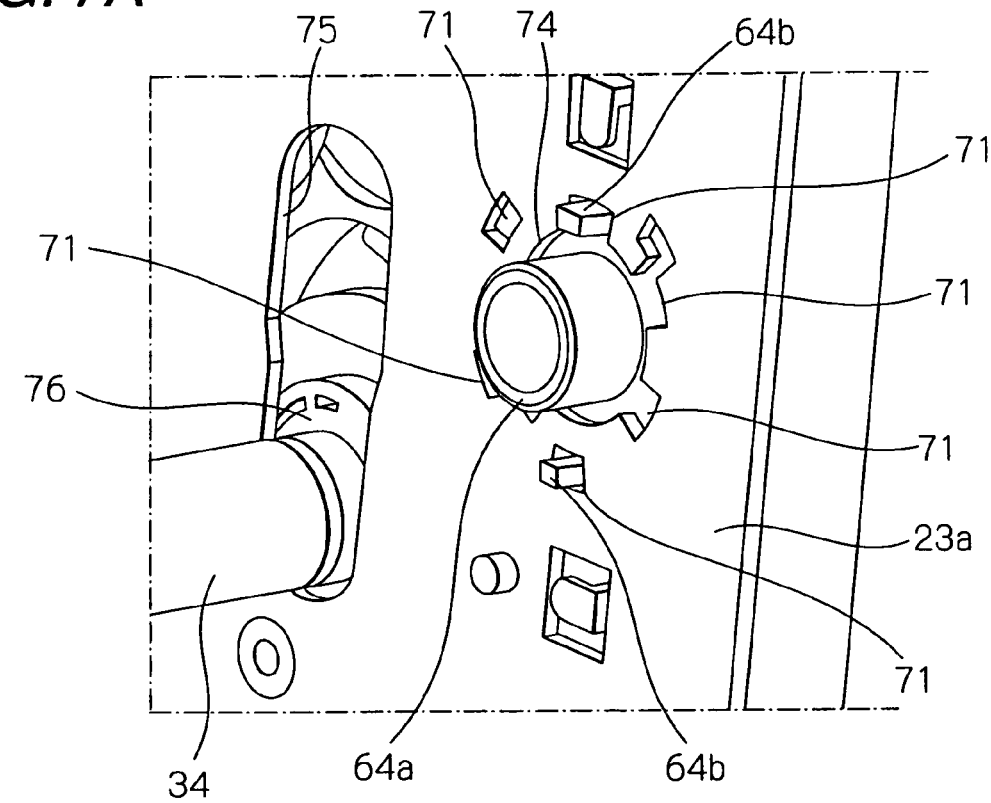
FIGS. 7A and 7B are enlarged perspective views showing how to operate the platen gap adjuster.
Figure 7B:
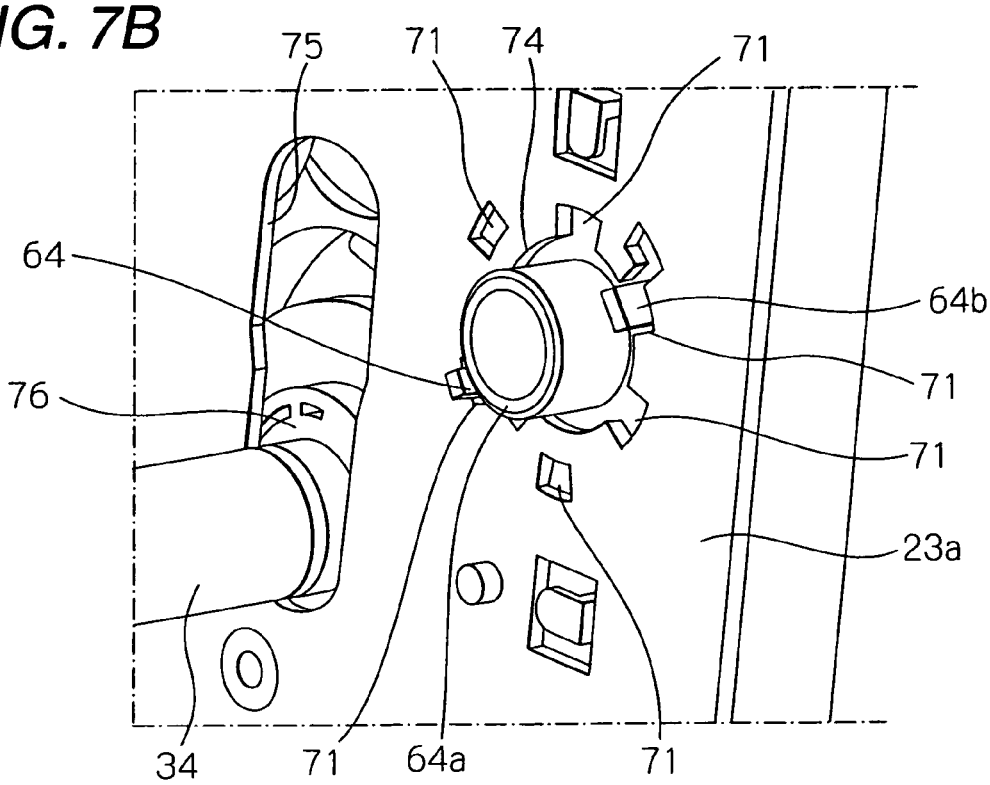

As shown in FIG. 3, the carriage guide shaft 34 is supported by a left side frame **23*b* and a right side frame 23*a*. More specifically, as shown in FIGS. 7A and 7B, the carriage guide shaft 34 is formed so as to penetrate through vertically-elongated guide grooves 75 formed in the respective right side frame 23*a* and left side frame 23*b*. Therefore, only vertical movement of the carriage guide shaft 34** is permitted, and horizontal movement of the same is not allowed.

Figure 11:
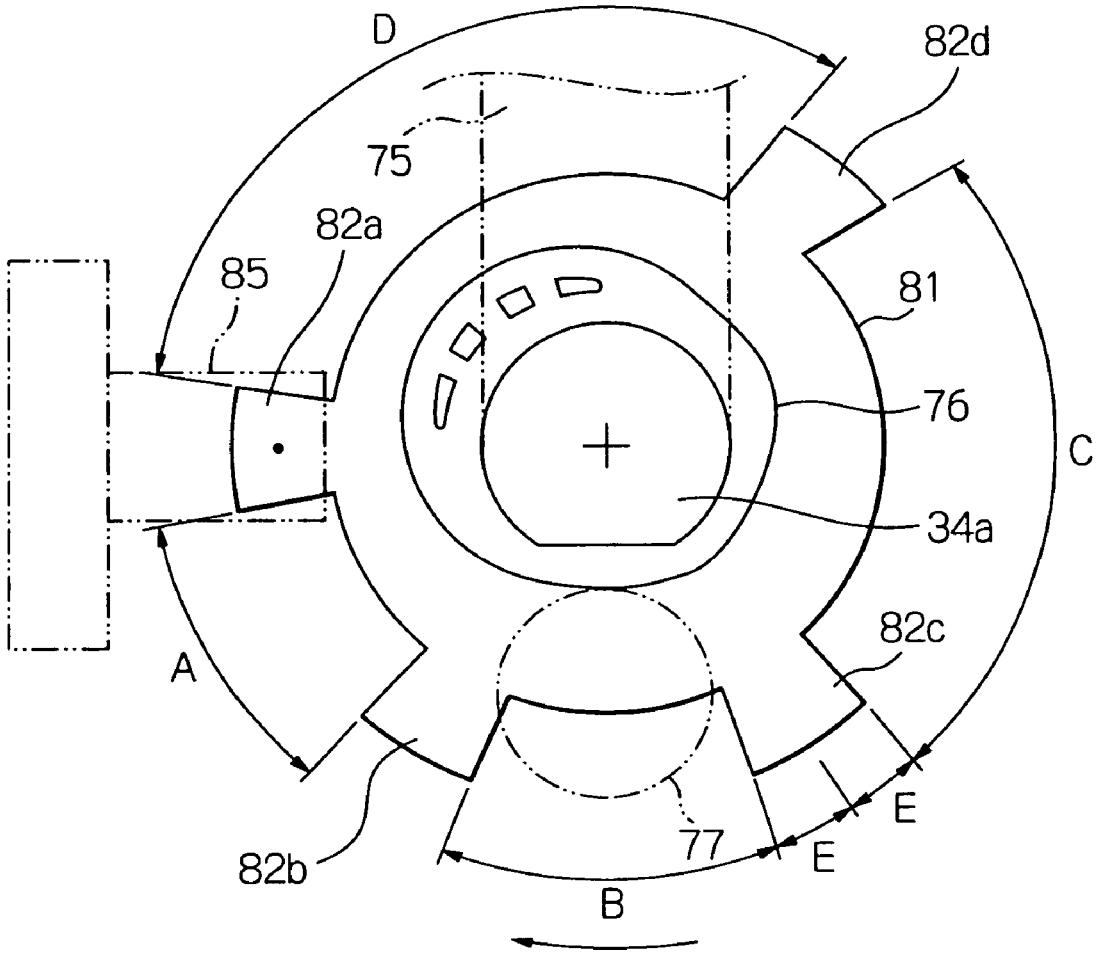
FIG. 11 is a side view of the platen gap detector.

Turning again to FIG. 4, a gear 66 is attached to a part of the carriage guide shaft 34 close to the right side frame **23*a*. As a result of power being transmitted from the power feeding motor 52 to the gear 66, the carriage guide shaft 34 rotates (described in detail later). As shown in FIG. 11, the gap adjusting cam 76 is attached to a shaft end 34*a* of the carriage guide shaft 34, and a cam follower pin 77 is fixedly provided in a position adjacent to the gap adjusting cam 76**.

When power is transmitted from the power feeding motor 52 to the gear 66, the gap adjusting cam 76 rotates, whereupon the position of the shaft center of the carriage guide shaft 34 is moved up and down by interaction of the outer peripheral face of the gap adjusting cam 76 with the cam follower pin 77, so that the platen gap can be adjusted. FIG. 11 shows the gap adjusting cam 76 and the cam follower pin 77, which are attached to the shaft end **34*a* of the carriage guide shaft 34 close to the left side frame 23*b*. An analogous gap adjusting cam 76 and an analogous cam follower pin 77 are provided on the shaft end of the right side frame 23***a*.

The power transmitter 67 that transmits power from the power feeding motor 52 to the carriage guide shaft 34 will now be described in detail. As shown in FIG. 4, the power feeding motor 52 is provided in a position close to the left side frame 23*b*, and the gear 54 is attached to the rotary shaft of the power feeding motor 52. The gear 54 meshes with the gear 55 attached to the shaft end of the transporting roller 30. Thus, the transporting roller 30 is rotationally driven.

The gear 56 is attached to the other shaft end of the transporting roller 30, and power is transmitted to the feeding device 2 (the feeding roller 12) by way of gears 57, 58, and 59. Moreover, power of the power feeding motor 52 is transmitted from the gear 59 to the gear 60 into which a spur gear 60*b* and a spur gear 60*c* are accumulated together by a shaft 60*a*; and further to the gear 66 attached to the shaft end of the carriage guide shaft 34 by way of gears 61, 62, 63, 64, and 65.

Constituent elements of a power transmission path which extends from the power feeding motor 52 to the carriage guide shaft 34 form the power transmitter 67 that transmits power from the power feeding motor 52 to the carriage guide shaft 34. The gear 58 transmits power to an unillustrated pump, as well. Thereby, negative pressure is fed to a cap (not shown) which seals the recording head 36. As mentioned above, the power feeding motor 52 acts as the common drive source among the transporting roller 30, the feeding roller 12, the unillustrated pump, and the carriage guide shaft 34.

Figure 5:
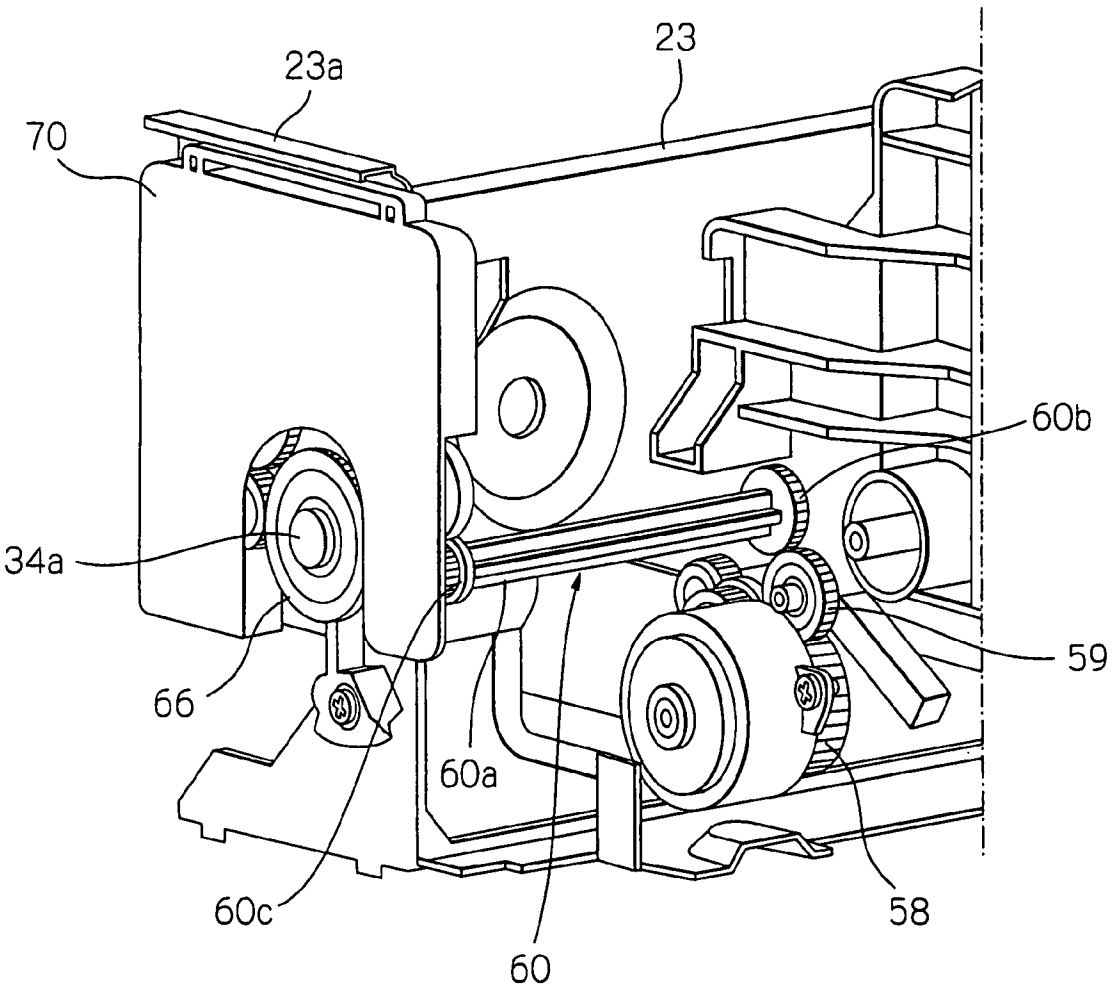
FIG. 5 is an enlarged perspective view of a power transmitter in the platen gap adjuster.
Figure 6:
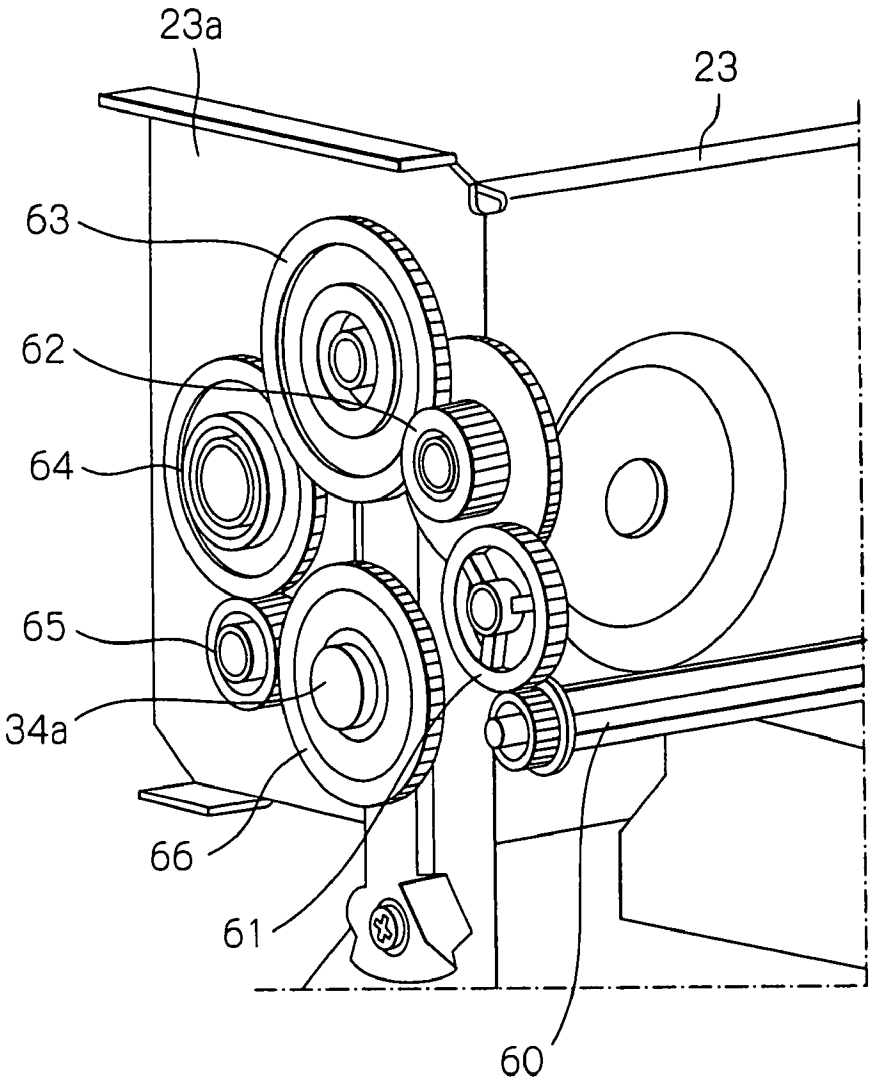
FIG. 6 is an enlarged perspective view of the power transmitter, showing a state that a gear cover is removed.

Next, a gear train 68 constituting a power transmission path that extends from the gear 60 to the gear 66 will be described in detail with reference to FIGS. 5 through 10 and other drawings, as required. FIG. 10 shows a state where the carriage 33 is situated in the vicinity of the home position. As illustrated, the right side of the travel area of the carriage 33 (the right side of the recording apparatus when viewed from front) serves as the home position of the carriage 33. As shown in FIGS. 5 and 6, the gear train 68 is attached to the right side frame 23*a* close to the home position in the travel area of the carriage 33. Specifically, the gear train 68 is disposed at the end of the travel area of the carriage 33 close to the home position of the carriage 33. Reference numeral 70 designates a cover which covers the gear train 68 and retains the gears.

The gears 60 to 66 that constitute the gear train 68 are attached to the right side frame 23*a* so as to be able to rotate around a rotary shaft parallel to the primary scanning direction. Of the gears, the gear 63 and the gear 64 are provided so as to be slidable in the axial direction of the rotary shaft of the gears 63, 64. First, the gear 64 is described in detail, as follows.

As shown in FIGS. 7A and 7B, a hole 74 is formed in the right side frame 23*a*. As shown in FIGS. 7 and 8, an engagement section 64*a*, which can engage with an engagement section 33*a* formed in a sidewall close to the home position of the carriage 33, is formed in the gear 64 as a result of projecting toward the inside of the right side frame 23*a* from the hole 74. The gear 64 is provided with the engagement section 64*a* being urged by a spring 78 in a direction to protrude to the inside of the right side frame 23*a* (toward the carriage 33).

Figure 8A:
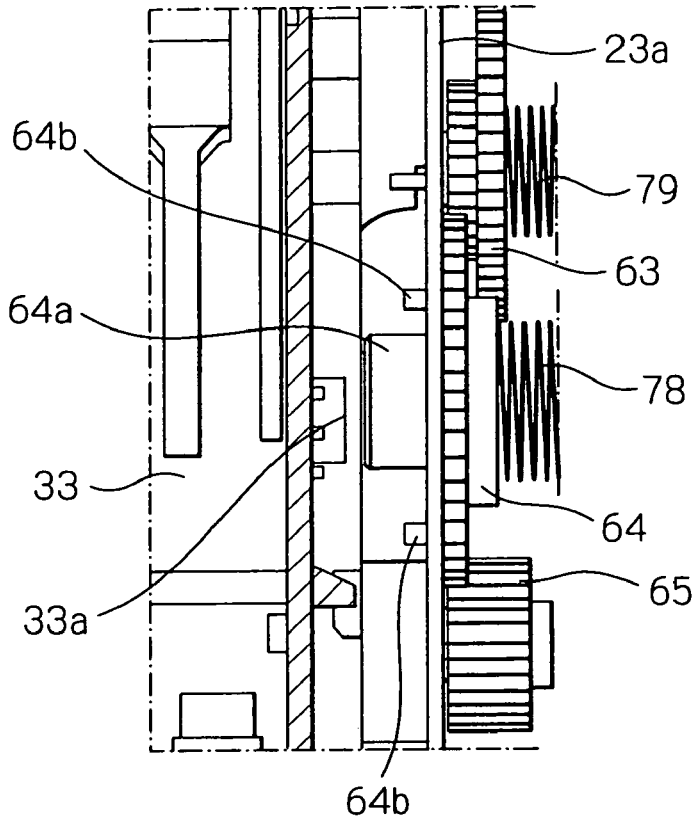

The gear 64 slidably moves axially along the rotary shaft thereof, so that the gear 64 can be displaced between a non-mesh position (a position shown in FIG. 8A) where the gear 64 does not mesh with the adjacent gear 63, and a mesh position (a position shown in FIG. 8B) where the gear 64 meshes with the gear 63. In a state where the carriage 33 does not press the engagement section 64*a*, the gear M assumes the non-mesh position by urging force of the spring 78 as shown in FIG. 8A. Specifically, the gear 64 enters a power disconnection state where the power transmitter 67 does not transmit power from the power feeding motor 52 to the carriage guide shaft 34.

Figure 8B:
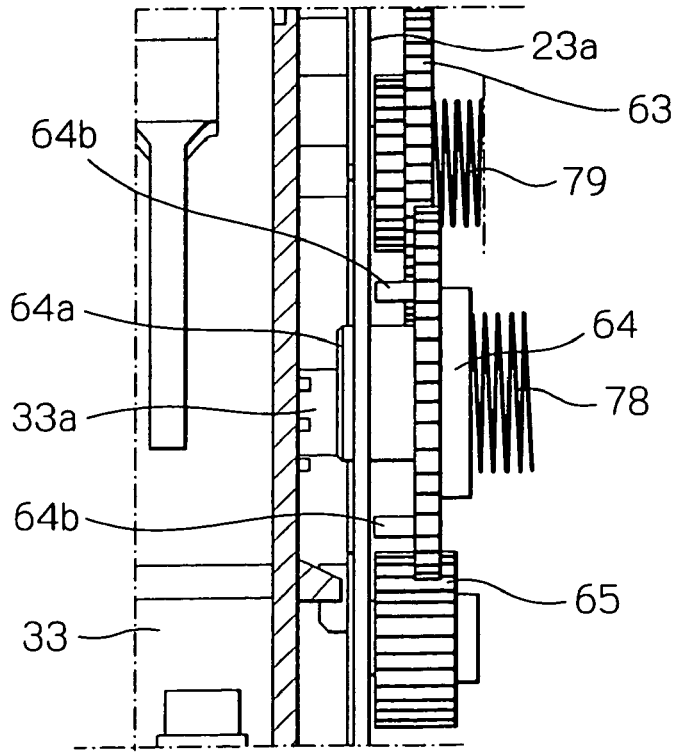
Figure 9A:
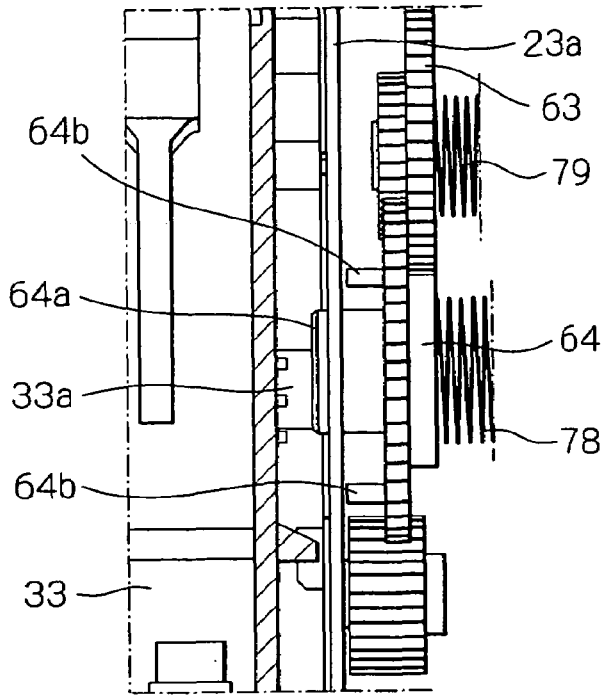

When the carriage 33 has moved to a position adjacent to the right side frame 23*a*, the carriage 33 presses the engagement section 64*a*, as shown in FIG. 8B, whereupon the gear 64 is displaced to a mesh position. Namely, there is achieved a power transmission state where the power transmitter 67 transmits power from the power feeding motor 52 to the carriage guide shaft 34.

Positioning pins 64*b* are formed in the surrounding area of the engagement section 64*a* so as to protrude toward the inside of the right side frame 23*a*. As shown in FIGS. 7B and 8B, as a result of the positioning pins 64*b* fitting into the fitting holes 71, the phase of the gear 64 is set to a predetermined position (the gear 64 becomes non-rotatable). In the present embodiment: the platen gap is configured to be switched among four head positions according to the size of the platen gap (described later in detail). The fitting holes 71 are formed in positions corresponding to the four head positions.

As mentioned above, when the platen gap is adjusted; namely, when switching among the head positions is performed, the carriage 33 is first moved to a position adjacent to the right side frame 23*a* so as to push the gear 64, thereby displacing the gear 64 into the mesh position. The power feeding motor 52 is rotated to a certain extent in this state, thereby rotating the carriage guide shaft 34 and switching the platen gap to a desired head position. The carriage 33 is caused to depart from the right side frame 23*a*, to thus bring the gear 64 into the non-mesh position and fitting the positioning pins 64*b* into the fitting holes 71, to thus fix the platen gap.

The reason why the gear 63 adjacent to the gear 64 is provided so as to be slidable in the direction of the rotary shaft of the gear 63 is as follows. Specifically, when the gear 64 moves from the non-mesh position (FIG. 8A) to the mesh position (FIG. 8B), there may arise a case where teeth of the gear 64 collide with the teeth of the gear 63, to thus end in a failure to attain proper meshing. When the carriage 33 forcefully presses the gear 64, there may also arise a case where the teeth are damaged. Consequently, the gear 63 is provided so as to be slidable in the direction of the rotary shaft thereof so that, even when the teeth of the gear 64 and the teeth of the gear 63 collide with each other, the gear 64 can be displaced to the mesh position (FIG. 9A).

Figure 9B:
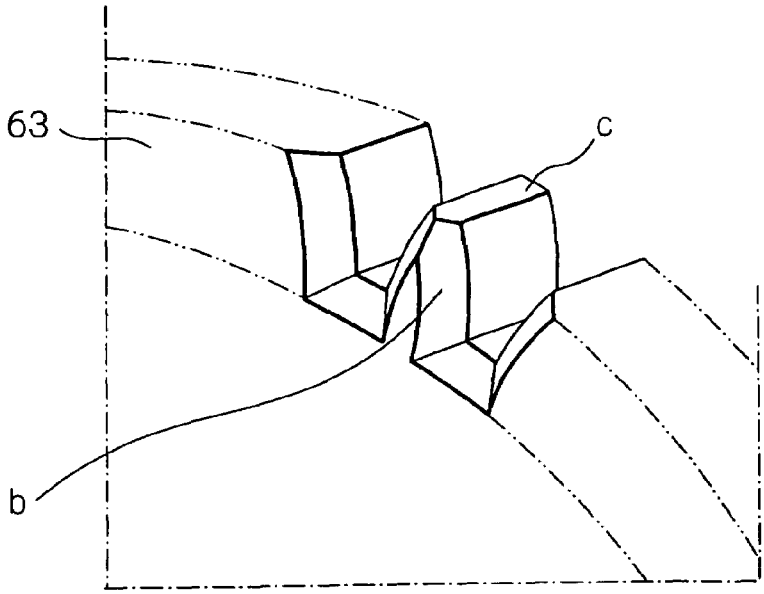
FIG. 9B is an enlarged perspective view showing a tooth shape of a gear in the power transmitter.
Figure 10:
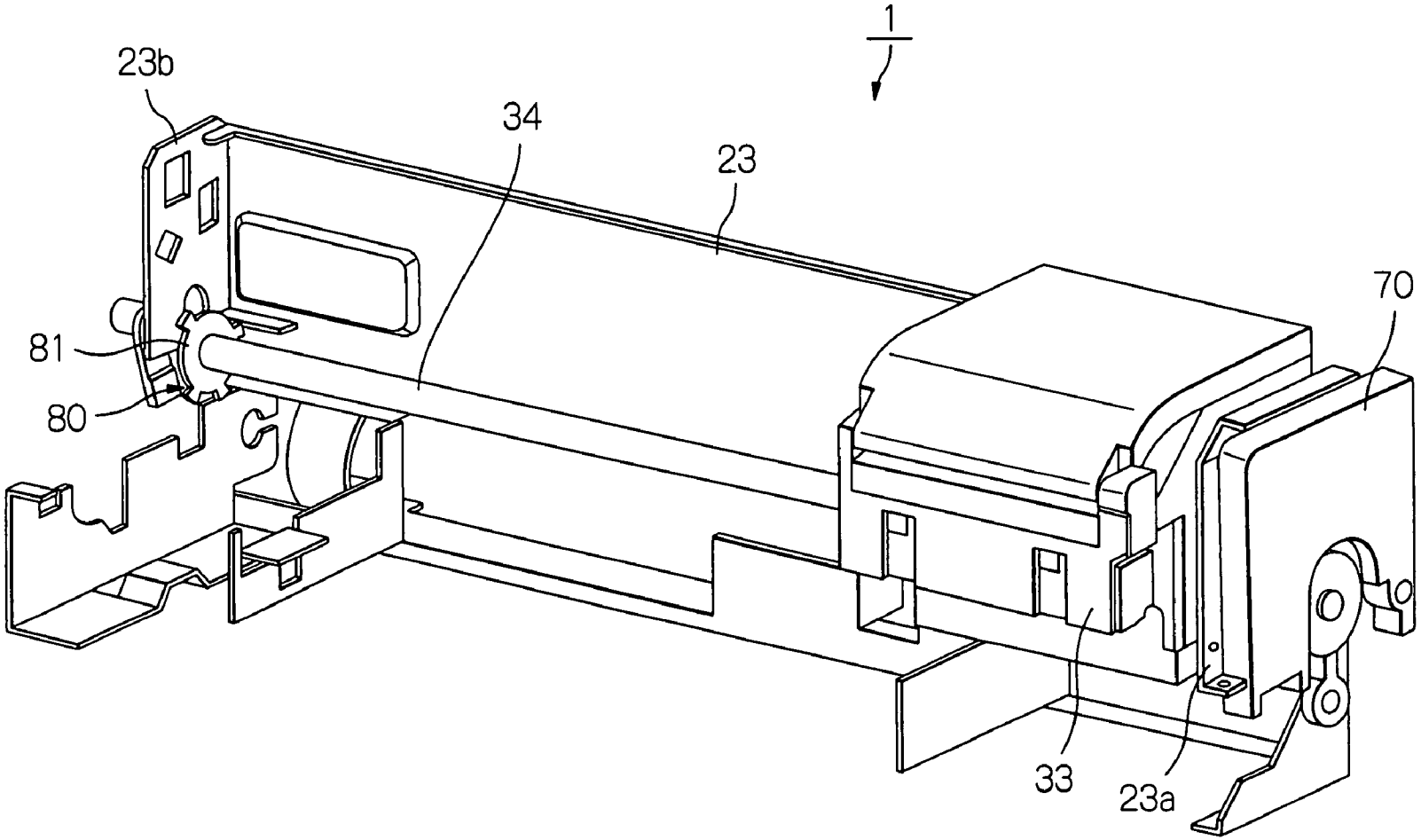
FIG. 10 is a perspective view of an internal structure of the printer, showing a platen gap detector.

As shown in FIG. 9B, a tooth "c" of the gear 63 is formed so as to have tapered faces "b." By the tapered faces, the gear 63 and the gear 64 smoothly mesh with each other in association with rotation of the gear 63. In FIGS. 8 and 9A, reference numeral 78 designates an spring for urging the gear 64 toward the non-mesh position. Reference numeral 79 designates another spring for urging the gear 63 to an ordinary position (a position where the gear 63 meshes with an adjacent gear).

In the printer 1 constructed as mentioned above, the gear 64, which acts as an engagement member for receiving a trigger from the carriage 33, is located in a position within the travel area of the carriage 33 close to the home position (i.e., the right side frame 23*a*). The gear 64 is located in a position with reference to the transporting path for the sheet P or the transporting path of the tray 50 with the home position of the carriage 33 being sandwiched therebetween. Accordingly, during the course of proceeding from the home position to press the gear 64, the carriage 33 does not need to straddle the transporting path for the sheet P or the transporting path of the tray 50; namely, does not interfere with the sheet P or the tray 50. Thereby, even when the platen gap is set to an inappropriate state, occurrence of interference between the recording head 36 and the sheet P or the tray 50 can be prevented. Further, the distance over which the carriage 33 travels when proceeding to press the gear 64 can be shortened by a great extent, so that switching of the platen gap can be performed within a short period of time.

Next, the configuration of the platen gap detector 80 and a sequence for detecting the reference platen gap will now be described in detail by reference to FIGS. 10 to 14.

As shown in FIG. 10, the left side frame 23*b* is provided with the platen gap detector 80 for detecting the current platen gap. As shown in FIG. 11, the platen gap detector 80 comprises a rotary plate 81 and a sensor 85. The rotary plate 81 has four flags 82*a*, 82*b*, 82*c*, and 82*d* which are provided along the outer periphery of the rotary plate 81 and project in a radial direction of the same. The rotary plate 81 is attached to the shaft end 34*a* of the carriage guide shaft 34 and rotates along with the carriage guide shaft 34.

The sensor 85 is an optical sensor having a light-emitting section (not shown) and a light-receiving section (not shown). The sensor 85 is provided in a predetermined position (a position which is between the carriage guide shaft 34 and the main frame 23 and is adjacent to the left side frame 23*b*) such that the flags 82*a* to 82*d* provided on the rotary plate 81 cross the optical axis of the sensor 85. Accordingly, when the carriage guide shaft 34 rotates, the control section 100 (FIG. 2) can detect passage of the flags 82*a* to 82*d* by a detection signal sent from the sensor 85. When the carriage guide shaft 34 is not rotating, presence/absence of-a flag can be detected; namely, the control section can detect the current head position where the flag is located or that the flag is not situated in any of the head positions, by a detection signal transmitted from the sensor 85.

The flags 82*a* to 82*d* are located in correspondence with the respective head positions. Specifically, in the present embodiment, the head positions are set in four steps, 1, 2, 3, and 4, in increasing sequence of the platen gap. By way of example, the platen gap in position 1 is set to 1.2 (mm); the platen gap in position 2 is set to 1.7 (mm); the platen gap in position 3 is set to 2.35 (mm); and the platen gap in position 4 is set to 4.2 (mm).

When the head position assumes "1" in association with rotation of the carriage guide shaft 34, the flag 82*a* blocks the optical axis of the sensor 85 as shown in FIG. 11. Similarly, when the head position assumes "2," the flag 82*b* blocks the optical axis of the sensor 85. When the head position assumes "3," the flag 82*c* blocks the optical axis of the senor 85. When the head position assumes "4," the flag 82*d* blocks the optical axis of the sensor 85. The control section 100 (FIG. 2) of the printer 1 determines which one of the flags is now blocking the optical axis of the sensor 85, by a method to be described later, and performs print control operation appropriate to the head position. A method for determining a head position will be described in detail later.

Figure 12:
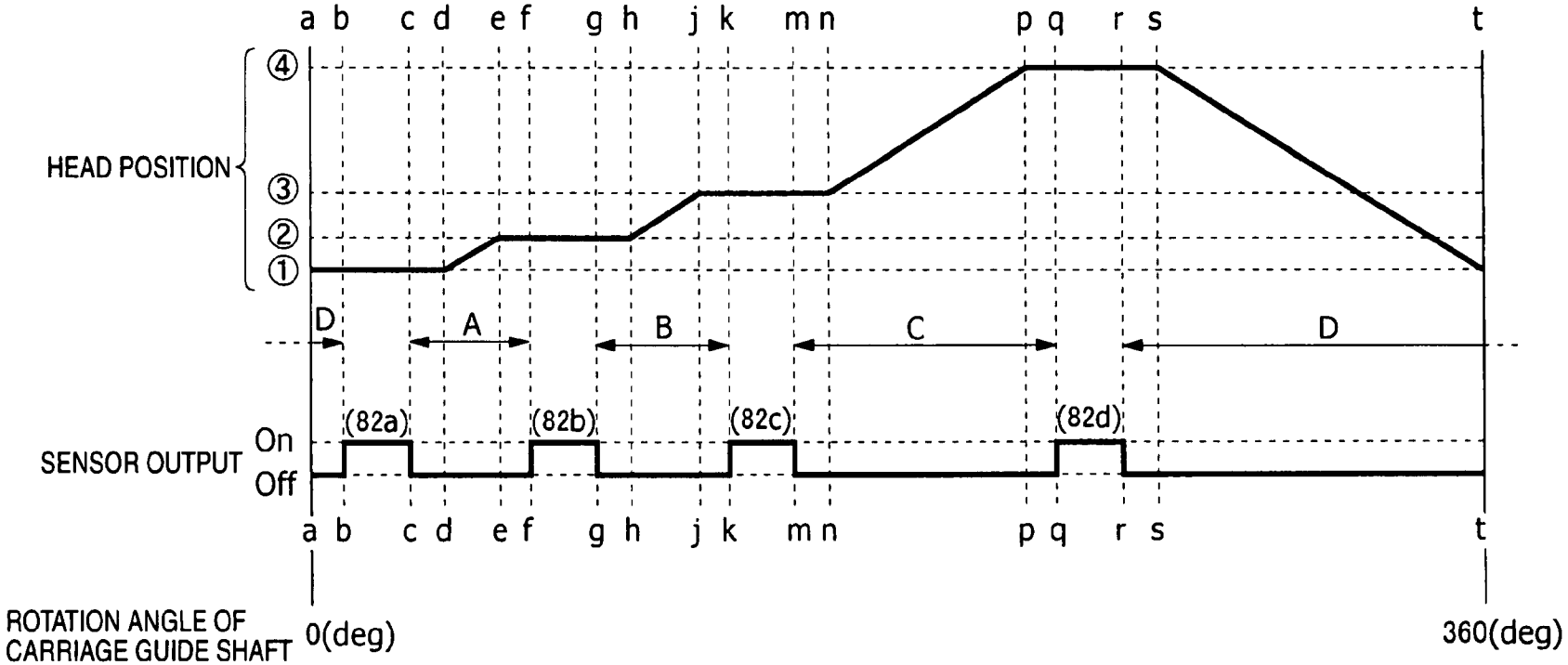
FIG. 12 is a diagram showing a relationship among a rotation angle of a carriage guide shaft, a sensor output from the platen gap detector and a platen gap.

Start point "a" in FIG. 12 represents the state shown in FIG. 11. When the carriage guide shaft 34 rotates through 360° from this state and reaches a point "t" in FIG. 12, the state returns to that shown in FIG. 11 (i.e., the point "a" is equal to the point "t"). Circled numerals (1 to 4) in FIG. 12 denote the respective head positions.

In FIG. 12, a segment during which the platen gap assumes the size of position 1 ranges from point "a" to point "d." A segment during which the flag 82*a* assigned to position 1 blocks the optical axis of the-sensor 85 is set to points "b" and "c." In this way, an area where the sensor 85 detects the flag 82*a* is set to the center of the segment where the platen gap actually assumes the size of position 1; namely, an area where the platen gap becomes most stable. This also applies to the remaining positions 2 to 4. Accordingly, the platen gap can be maintained stably.

Figure 13:
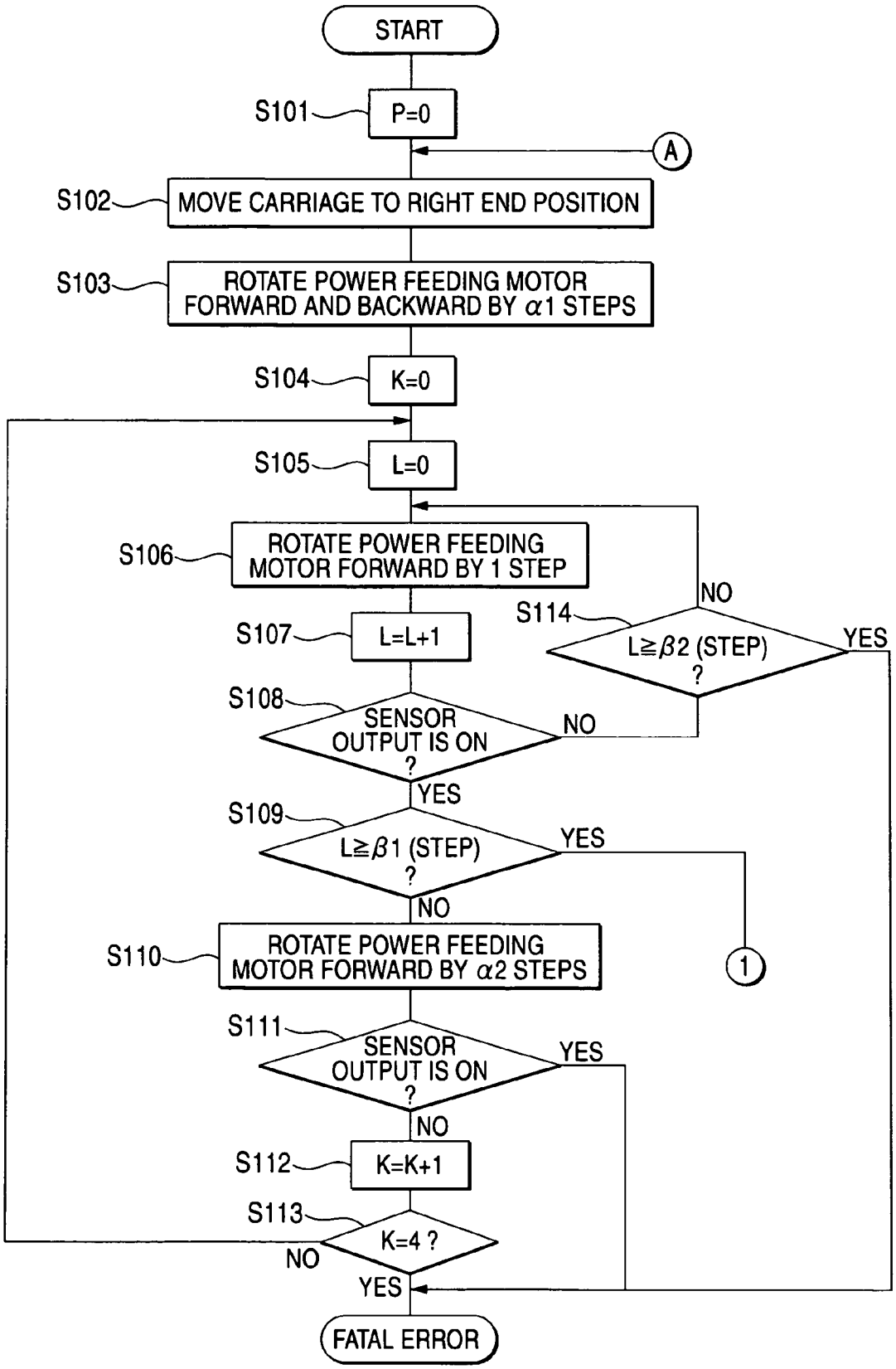
FIGS. 13 and 14 are flow charts showing operations for determining a reference platen gap.
Figure 14:
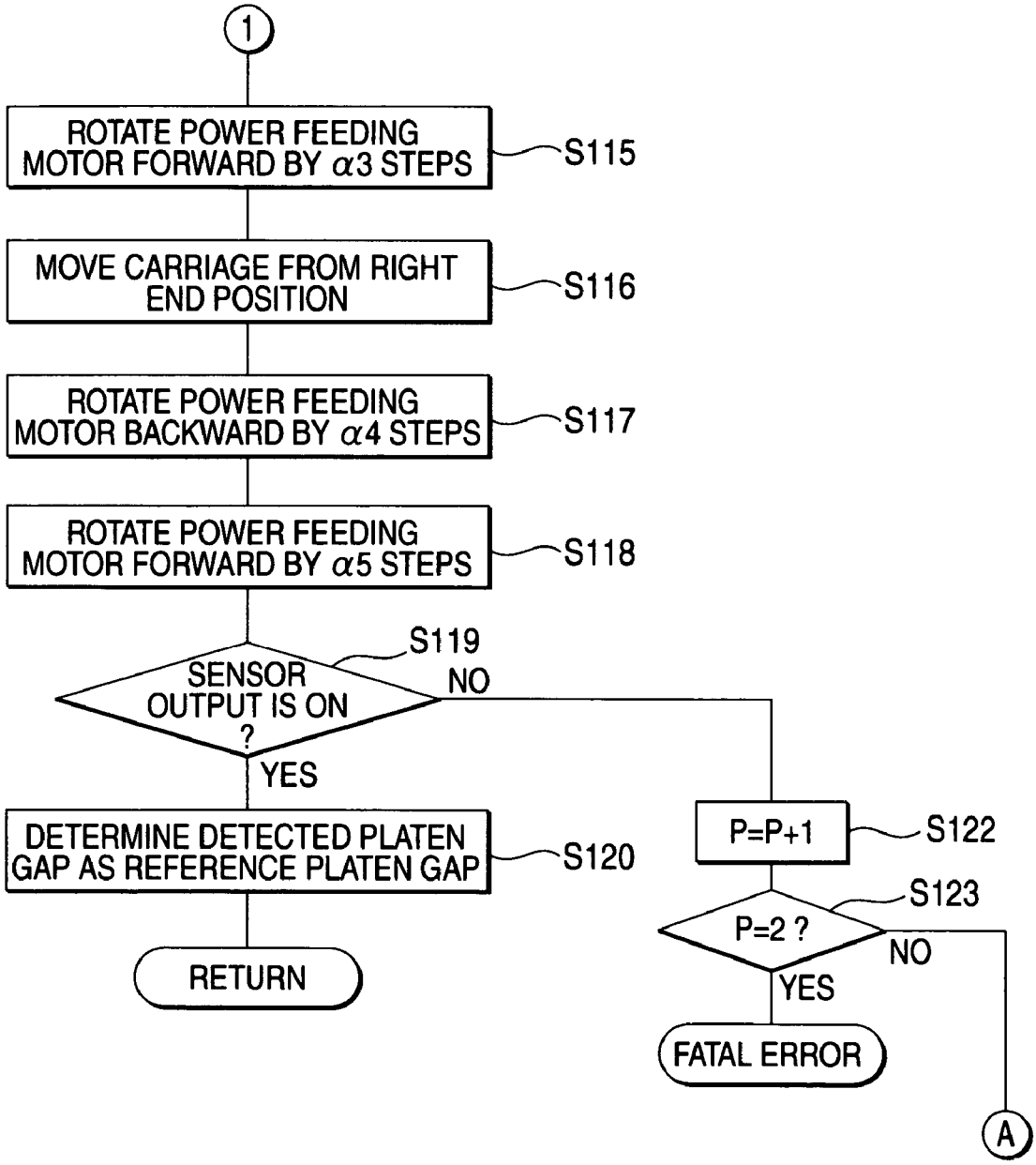

Next, a sequence for detecting the reference platen gap will now be described by reference to FIGS. 13 and 14. The term "number of rotation steps of the power feeding motor 52" used herein signifies the number of pulses (the number of steps) transmitted from the rotary encoder 118 (FIG. 2) in association with rotation of the power feeding motor 52. In the present embodiment, the "reference platen gap" corresponds to the head position 1. The sequence, which will be described hereunder, is for the control section 100 (FIG. 2) detecting the flag 82*a* assigned to head position 1.

In order to detect the reference platen gap, a variable P (described in detail later) showing the number of retries is first reset to zero (step S101), and the carriage 33 is then moved to a position adjacent to the right side frame 23*a*; i.e., the right end position (step S102). Thereby, the gear 64 is displaced to the mesh position shown in FIG. 8B, and the power transmitter 67 enters the power transmission state where power is transmitted from the power feeding motor 52 to the carriage guide shaft 34.

Next, the power feeding motor 52 is rotated forward by $\alpha 1$ steps and backward by $\alpha 1$ steps (step S103). As mentioned above, when the gear 64 moves from the non-mesh position (FIG. 8A) to the mesh position (FIG. 8B), there may arise a case where the teeth of the gear 64 collide with the teeth of the gear 63, to thus fail to attain proper meshing. When the teeth of the gears have failed to mesh properly as mentioned above, the gear 63 is rotated slightly (forward and backward), so that the teeth of the respective gears can be meshed with each other. Accordingly, $\alpha 1$ is preferably set to such a value that a gear is rotated to at least an amount corresponding to a product which is determined by multiplying a tooth pitch of the gears by 0.5 or more. In the present embodiment, the thus-determined value is further multiplied by a safety factor of 1.2, and consideration is paid to backlash of the gear. Specifically, given that the pitch of teeth is "p" and a backlash is taken as "j," $\alpha 1$ is set such that the teeth are fed by an amount of (0.5 p+j).

Next, a variable K showing the number of detected flags is reset to zero (step S104), and a variable L showing the total number of rotational steps (an accumulated value) of the power feeding motor 52 is reset to zero (step S105). The power feeding motor 52 is rotated forward by one step, and the variable L is incremented (steps S106, S107). Consequently, when the sensor 85 is determined to have been activated; namely, when any one of the flags 82*a* to 82*d* can be determined to have blocked the optical axis of the sensor 85 (Yes in step S108), a determination is made as to whether or not the variable L achieved at this time is $\beta 1$ steps or more (step S109). Alternatively, when the sensor 85 can be determined to have been deactivated; namely, when any one of the flags 82*a* to 82*d* can be determined to have failed to block the optical axis of the sensor 85 (No in step S108), a determination is made as to whether or not the variable L achieved at this time is $\beta 2$ steps or more (step S114).

The significance of $\beta 1$ steps and that of $\beta 2$ steps will be described in detail. Of the flags 82*a* to 82*d*, a circumferential interval between the rotation detection members 81 of two adjacent flags is expressed by symbols A, B, C, and D as shown in FIGS. 11 and 12. For instance, point "c" in FIG. 12 shows a position where the flag 82*a* comes off the optical axis of the sensor 85. When the rotary plate 81 rotates from this position by angle A, point "f" is reached, where the next flag 82*b* blocks the optical axis of the sensor 85. The same also applies to angles B, C, and D.

In the present embodiment, angle D is set to become the largest, and angle C is set to become the second largest. Symbol β1 denotes the number of rotation steps of the power feeding motor 52 required when the rotary plate 81 is rotated through an angle which is determined by multiplying angle C by a safety factor of 1.2. Symbol β2 denotes the number of rotation steps of the power feeding motor 52 required when the rotary plate 81 is rotated through an angle which is determined by multiplying angle D by a safety factor of 1.2.

When the variable L, which is an accumulated value of the number of rotation steps of the power feeding motor 52, is determined to be smaller than β1 (No in step S109), the flag detected in step S108 can be determined to be any one of the flags 82*b*, 82*c*, and 82*d* (the next flag has been detected as a result of the power feeding motor 52 having rotated through any of angles A, B, and C). In this case, the power feeding motor 52 is rotated by α2 steps, and the flag (in this case, any one of the flags 82*b*, 82*c*, and 82*d*) is caused to come off the optical axis of the sensor 85 without fail (step S110).

Symbol α2 denotes the number of rotation steps of the power feeding motor 52 for causing the flag to come off the sensor 85 without fail; namely, the number of rotation steps of the power feeding motor 52 required when the rotary plate 81 is rotated by an angle which is determined by multiplying an angle, which is double angle E in FIG. 11, by the safety factor.

Consequently, when the sensor 85 still remains activated despite operation for causing the flag to come off the optical axis of the sensor 85 without fail having been performed in step S110 (Yes in step S111), any anomaly has arisen. In that case, processing is terminated as a fatal error. When the sensor 85 has become deactivated (No in S111), the flag has properly come off the optical axis of the sensor 85, and hence variable K showing the number of flags detected is incremented (step S112).

A determination is made as to whether or not K=4 is achieved. When K=4 is achieved (Yes in step S113), all of the flags have been detected despite a failure to detect the flag 82*a* serving as a reference; namely, a failure to the largest interval between the flags (the interval between the flags 82*d* and 82*a*). Even in this case, processing is terminated as a fatal error. When K assumes a value of less than four (No in step S113), processing returns to step S105, and the next flag is successively detected.

When the number of rotation steps of the power feeding motor 52 has exceeded β2 steps in step S114, none of the flags have been detected even when the rotary plate 81 has been rotated through angle D, which corresponds to the largest interval between the flags (the interval between the flags 82*d* and 82*a*), or more. In this case, processing is terminated as a fatal error (Yes in step S114).

When the sensor 85 has become activated (Yes in step S109), the flag 82*a* has blocked the optical axis of the sensor 85 (point "b" in FIG. 12). In this case, processing proceeds to step S115 in FIG. 14, where the power feeding motor 52 is rotated forward by α3 steps. Here, symbol α3 denotes the number of rotation steps of the power feeding motor 52 for causing the optical axis of the sensor 85 to be situated at the center of the flag 82*a*. Specifically, symbol α3 signifies the number of rotation steps of the power feeding motor 52 in order to rotate the rotary plate 81 through angle E in FIG. 11. With this configuration, the optical axis of the sensor 85 comes to the center of the flag 82*a*.

Next, in this state, the power transmitter 67 (FIG. 4) remains in a power transmission state where power is transmitted from the power feeding motor 52 to the carriage guide shaft 34 (a state in FIG. 8B). Hence, the carriage 33 is caused to recede from the right side frame 23*a* (step S116), to thus disengage the teeth of the gear 64 from the teeth of the gear 63, as shown in FIG. 8A.

By the forward rotation of the power feeding motor 52 in step S115, the teeth of the gear 64 and the teeth of the gear 63 remain in compressed contact with each other. Accordingly, even when the carriage 33 has receded in step S116, there may arise a case where the teeth of the gear 63 and the teeth of the gear 64 remain meshed with each other. When the power feeding motor 52 has rotated in this state, there may also arise a case where the optical axis of the sensor 85 comes off the center of the flag 82*a* and further from the flag 82*a*. Accordingly, in step S117 the power feeding motor 52 is slightly rotated backward by α4 steps corresponding to a backlash of the gear. Thereby, the teeth of the gear 63 and the teeth of the gear 64 are released from a compressed contact, and the gear 64 can be reliably displaced to the non-mesh position by urging force of the spring 78.

The teeth of the gear 64 and the teeth of the gear 63 can also be reliably disengaged from each other, or the power transmitter 67 can also be brought into a power disconnected state, by sufficiently increasing the urging force of the spring 78 that urges the gear 64 to the non-mesh position in FIG. 8A.

There is a case where the gear 64 is displaced to the non-mesh position by the urging force of the spring 78 with a slight lag behind the moment when the carriage 33 has receded in step S116. In such a case, collision sound, which would arise when the engagement section 64*a* collides with the carriage 33, may arise. However, as a result of an increase in the urging force of the spring 78, the gear 64 is immediately displaced to the non-mesh position as a result of the receding action of the carriage 33, thereby preventing occurrence of collision sound.

Turning again to FIG. 14, the power feeding motor 62 is forwardly rotated by α5 steps in step S118. In the present embodiment, α5 denotes the number of rotation steps of the power feeding motor 52 required when the rotary plate 81 is rotated through an angle which is double angle E in FIG. 11; namely, the number of rotation steps of the power feeding motor 52 required when the rotary plate 81 is rotated through an angle corresponding to one flag.

However, at this point in time, the gear 64 and the gear 63 should have been disengaged from each other. Accordingly, even when the power feeding motor 52 has been rotated forward by α5 steps, no changes should arise in the sensor 85. Step S119 is for determining that no changes have arisen in the sensor 85. If the sensor 85 still remains activated (Yes), the detected platen gap is determined as the reference platen gap. In other words, it is determined that the flag 82*a* corresponding to the head position 1 is detected (step S120).

Meanwhile, when the sensor 85 has become deactivated in step S119, the rotary plate 81 has been rotated by forward rotation of the power feeding motor 52; namely, the gear 64 and the gear 63 still remain meshed with each other. In this case, all the above-mentioned processing operations are again performed (No in step S123). When variable P has assumed a value of 2 (Yes in step S123) as a result of increment in variable P which shows the number of retries in S122, processing is terminated as a fatal error.

The flags 82*a* to 82*d* are provided along the outer periphery of the rotary plate 81 in correspondence with the respective head positions (1 to 4). By detection of the flags 82*a* to 82*d*, the current position of the platen gap can be determined to be any one of a plurality of head positions. At least one circumferential interval between the flags is set uniquely such that circumferential intervals between the other flags become different from each other. In the present embodiment, the circumferential interval is set to a unique value such that circumferential intervals among all flags become different from each other (see angles A to D shown in FIGS. 11 and 12).

When the largest interval between the flags (angle D) has been detected during the course of rotation of the carriage guide shaft 34 in the clockwise direction (as indicated by an arrow in FIG. 11) in the present embodiment, the detected flag is determined to be the flag 82*a* corresponding to head position 1 set to the minimum the platen gap. So long as the flag 82*a* is detected, the positions of other flags (82*b*, 83*c*, and 82*d*) in relation to the flag 82*a*; namely, the numbers of rotations of the power feeding motor 52 required to switch the platen gap from position 1 to positions 2, 3, and 4, are determined. Hence, the platen gap can be accurately switched to a desired position by a single sensor 85.

the platen gap can also be switched to another position by solely managing the number of rotation steps of the power feeding motor 52 after detection of the flag 82*a* that serves as a reference. However, since the respective flags are provided in correspondence with the respective positions, the platen gap can be switched to a desired position with higher accuracy by monitoring activation/deactivation of the sensor 85 in conjunction with the number of rotation steps of the power feeding motor 52.

Incidentally, in the printer 1 of the present embodiment, the power feeding motor 52 drives a plurality of objects to be driven, in view of cost saving. Consequently, when the power feeding motor 52 is rotated backward, power is transmitted to another object to be driven, which may in turn induce a failure. For these reasons, even when the carriage guide shaft 34 is rotated, the essential requirement is to rotate the carriage guide shaft 34 in only one direction. Therefore, a desire to rotate such a carriage guide shaft 34 in only one direction can be met.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A liquid ejecting apparatus, comprising:

a liquid ejecting head, adapted to eject liquid toward a target medium;

a platen, adapted to support the target medium;

a rotatable guide shaft, extending in a first direction;

a carriage, mounting the liquid ejecting head and being supported by the guide shaft so as to reciprocately movable thereon;

a gap adjuster, operable to rotate the guide shaft, thereby moving an axis of the guide shaft in a second direction orthogonal to the first direction to selectively determine a distance between the liquid ejecting head and the platen as one of a plurality of distances;

a circular plate, provided on the guide shaft and rotatable together with the guide shaft, the circular plate comprising a plurality of flags formed on an outer periphery thereof, each of which is associated with one of the distances; and a sensor, disposed in the vicinity of the outer periphery of the circular plate and operable to output a signal indicative of a passage of each of the flags in accordance with the rotation of the circular plate, wherein at least one of intervals between the flags in a circumferential direction of the circular plate is set to be different from the other, the liquid ejection apparatus further comprising:

a first motor, operable to rotate the guide shaft;

a detector, operable to detect a rotation amount of the first motor;

a controller, operable to identify one of the flags forming the at least one of the intervals with reference to the signal and the rotation amount;

a second motor, operable to move the carriage along the guide shaft; and a transmitter, configured to be actuated by the carriage so as to be either a first state for transmitting a driving force from the first motor to the guide shaft, or a second state for not transmitting the driving force from the first motor to the guide shaft, wherein the controller is configured to drive the second motor to move the carriage so as to place the transmitter in the first state before the identification of the one of the flags, and wherein the transmitter comprises:

a gear train, coupling the first motor and the guide shaft, the gear train including a spur gear having a rotary shaft extending parallel to the first direction; and an urging member, urging the spur gear toward the carriage;

the spur gear is slidable in the first direction between a first position meshing with an adjacent gear in the gear train to place the transmitter in the first state and a second position separating from the adjacent gear to place the transmitter in the second state;

the spur gear is placed in the first position when the carriage presses the rotary shaft against an urging force of the urging member;

the spur gear is placed in the second position in accordance with the urging force when the carriage is separated from the rotary shaft;

the controller is configured to drive the second motor to move the carriage so as to separate from the rotary shaft, after the identification of the one of the flags; and the controller is configured to drive the first motor so as to reverse a rotating direction thereof, after the separation of the carriage from the rotary shaft.

2. The liquid ejecting apparatus as set forth in claim 1, further comprising a transmitter, configured to be actuated by the carriage so as to be either a first state for transmitting a driving force from the first motor to the guide shaft, or a second state for not transmitting the driving force from the first motor to the guide shaft, the transmitter disposed in an opposite side to a transporting path of the target medium relative to a home position of the carriage.

3. The liquid ejecting apparatus as set forth in claim 2, wherein the transporting path is adapted to transport a tray member mounting the target medium.

4. The liquid ejecting apparatus as set forth in claim 2, further comprising a first roller, adapted to transport the target medium in a third direction orthogonal to the first direction and the second direction, the roller arranged in an upstream side of the liquid ejecting head relative to the third direction, wherein the transmitter is configured to transmit the driving force by way of the roller.

5. The liquid ejecting apparatus as set forth in claim 4, further comprising a second roller, adapted to transport the target medium toward the first roller, wherein the transmitter is configured to rotate the second roller in cooperation with the first roller.

6. The liquid ejecting apparatus as set forth in claim 2, wherein:

the transmitter comprises a gear train, coupling the first motor and the guide shaft, the gear train including a spur gear having a rotary shall extending parallel to the first direction; and the spur gear is slidable in the first direction between a first position meshing with an adjacent gear in the gear train to place the transmitter in the first state and a second position separating from the adjacent gear to place the transmitter in the second state.

7. The liquid ejecting apparatus as set forth in claim 1, wherein one of the flags forming the at least one of the intervals is associated with a minimum one of the distances.

8. A gap detecting method executed in the liquid ejecting apparatus as set forth in claim 1, comprising:

rotating the guide shaft with a first motor:

detecting a rotation amount of the first motor; and identifying one of the flags forming the at least one of the intervals with reference to the signal and the rotation amount.

9. The detecting method as set forth in claim 8, further comprising:

providing a transmitter, configured to be actuated by the carriage so as to be either a first state for transmitting a driving force from the first motor to the guide shaft, or a second state for not transmitting the driving force from the lirst motor to the guide shaft; and moving the carriage along the guide shaft with a second motor so as to place the transmitter in the first state before the identification of the one of the flags.

10. The detecting method as set forth in claim 9, further comprising:

configuring the transmitter so as to comprise:

a gear train, coupling the first motor and the guide shaft, the gear train including a spur gear having a rotary shall extending parallel to the first direction; and an urging member, urging the spur gear toward the carriage;

configuring the spur gear so as to be slidable in the first direction between a first position meshing with an adjacent gear in the gear train to place the transmitter in the first state and a second position separating from the adjacent gear to place the transmitter in the second state;

driving the second motor to move the carriage so as to press the rotary shaft against an urging force of the urging member, thereby placing the spur gear in the first position;

driving the second motor to move the carriage so as to separate from the rotary shaft after the identification of the one of the flags, thereby placing the spur gear in the second position in accordance with the urging force when the carriage is separated from the rotary shaft; and driving the first motor so as to reverse a rotating direction thereof, after the separation of the carriage from the rotary shaft.

* * * * *